US005690334A

United States Patent [19]

Duke

[11] Patent Number: 5,690,334

[45] Date of Patent: Nov. 25, 1997

[54] EXPANDED CHESS-LIKE GAME

[76] Inventor: George William Duke, P.O. Box 2204, Englewood, Colo. 80150

[21] Appl. No.: 734,722

[22] Filed: Oct. 21, 1996

[51] Int. Cl.[6] ..... H63F 3/02

[52] U.S. Cl. ..... 273/261

[58] Field of Search ..... 273/236, 242, 273/260, 261

[56] References Cited

U.S. PATENT DOCUMENTS

| | | | |
|---|---|---|---|
| 1,405,988 | 2/1922 | Erwin . | |
| 4,015,849 | 4/1977 | MacLean . | |
| 4,033,586 | 7/1977 | Corinthios . | |
| 4,052,069 | 10/1977 | Sandhu | 273/261 |
| 5,306,017 | 4/1994 | Huston | 273/261 |
| 5,421,582 | 6/1995 | Ritter | 273/261 |
| 5,484,157 | 1/1996 | King | 273/260 |
| 5,511,793 | 4/1996 | Watt | 273/260 |

FOREIGN PATENT DOCUMENTS

| | | | |
|---|---|---|---|
| 2617053 | 12/1988 | France | 273/260 |
| 2201351 | 9/1988 | United Kingdom | 273/260 |

OTHER PUBLICATIONS

John Gollon, Chess Variations, Charles E. Tuttle Co., Rutland, Vermont, & Tokyo, Japan, 1968, pp. 209–219.

H. J. R. Murray, A History of Chess, Clarendon Press, Oxford England, 1913, pp. 344–348.

Internet, The Chess Variant Pages, http://www.cs.ruu.nl: 80/~hansb/d.chessvar/var/index.html, mntnd. by Hans Bodlaender, Univ. of Utrecht, "ChesKers, Sep. 4, 1996, " Chess--Battle, Sep. 20, 1996, Jetan, Jan. 10, 1995.

David Pritchard, Encyclopedia of Chess Variants, Games & Puzzles Publications, P.O.B. 20, Godalming, Surrey, United Kingdom, 1994, especially p. 9 (Frank Moody), p. 20 (Jim Bates and Paul Schooling), p. 26 (H.E.Bird), p. 29 (D.A. Braithwaite), p. 42 (Frank Maus), p. 47 (Ron Kensek), pp. 51–52 (A. S. Yurgelevich), p. 58 (Bruce Trone), p. 59 (D. Trovillon), (Bruce Trone), p. 59 (D. Trovillon), p. 63 (Giuseppe Ciccolini), p. 77 (Prof. German A. Mentz), David Pritchard, Encyclopedia of Chess Variants, esp. also, p. 81 (T. A. Poppe), p. 82 (V.R. Parton), pp. 83–84 (Albert Saaghy de Saagh), p. 96 (Max Rieck), p. 122 (Bruce Gilson), pp. 152–153 (V.Z. Kesselman), p. 158 (Jeffrey Shaffer), p. 193 (Stanislaw Hofmokl–Ostrowski), p. 194 (Prince Joli Kansil), p. 194 (Mideast Chess, inventor unknown), p. 223 (Istvan Pavlovits), p. 227 (Pieces–Pritchard), p. 253 (Linda Blomer et al.), p. 261 (Stephen Sava), pp. 341–342 (Wayne Schmittberger).

*Primary Examiner*—William E. Stoll

[57] ABSTRACT

A new, expanded chess-like game, called Falcon Chess (24), is disclosed, comprising a game board (25) and chess pieces for use by two players. The game board (25) has a flat rectangular surface of alternating dark-colored squares (27) and light-colored squares (26) in the customary checkerboard pattern. The eight rank rows of orthodox chess carry over to Falcon Chess (24), and ten file rows, instead of eight, accomodate the new, separate falcon game piece. The chess pieces of each player include a king (30), a queen (32), two falcons (28), two bishops (36), two knights (38), two rooks (34), and ten pawns (40). The falcon's move is uniquely three-square, defined in a combination of both straight and diagonal movements, in any order. The move consists of two diagonal steps in the same direction and one straight step. Alternately, the move is two straight steps in the same direction and one diagonal step.

18 Claims, 8 Drawing Sheets

EXPANDED CHESS-LIKE GAME

BACKGROUND

1. Field of Invention

This invention relates to chess-like games, specifically to improvements, expansions, or variants of orthodox chess.

2. Description of Prior Art

A) History and movement of the pieces

Originating in Asia, orthodox chess is a game of skill for two players, played upon an eight-by-eight square, checkered game board. Chess rules and movements of the pieces have been essentially unchanged for five hundred years. The game consists of the six familiar types of pieces with their accepted modes of movement. The king moves any direction one square at a time. The rook moves in a straight direction (vertically or horizontally) any number of squares. The bishop moves diagonally any number of squares. The knight moves one straight, then one diagonally at a forty-five degree angle. Alternately, the knight moves one diagonal, then one straight at a forty-five degree angle. Yet again, rules of chess describe the knight's movement as "L-shaped," two squares in one straight direction, then one square orthogonally. These three descriptions of the knight's movement mount to the same two-square move because this piece alone can jump, or leap, over an intervening piece.

The queen has a choice of movement like either a bishop or a rook in one turn. The pawn moves one square forward, with the option of two squares before it has been moved once. The pawn captures diagonally, whereas the other pieces capture in their ordinary movement. A capture removes one of the opponent's pieces from play, and thus no two pieces occupy the same square at the same time. The castling move transposes a player's king and rook in the following way. Over unoccupied and unthreatened squares, the king is moved two squares horizontally, right or left, toward a rook, and that rook is moved over the king to the adjacent square.

Turns alternate between the two opponents, or sides, white and black, until one player checkmates the other. In checkmate, a player's king cannot successfully move out of a check, where it is threatened with capture. Briefly, these are the rules for movements and play of the pieces in orthodox, or classical, or standard chess, all three terms being used synonomously. Some national differences remained on points of stalemate, castling, pawn promotion, and the pawn en passant rule. As a result, laws of chess were further universalized in the twentieth century to the game today.

B) Suggested revisions of orthodox chess

There have been proposals to expand or enlarge orthodox chess, or alter its rules, to make the game more interesting. The reason behind the call for change is that outcomes of many strategies of play have become recognizable, well-known, or over-analyzed. In order to create a more challenging game, suggested revisions to orthodox chess have come from many sources. These variations have often entailed creation of new pieces for use with orthodox pieces, as well as new boards or rules.

Thomas Raynor Dawson, a noted inventor of novel chess ideas, proposed several "fairy chess" pieces, as unorthodox, or nonclassical, pieces are called. Created in 1912, Dawson's grasshopper moves along queen-lines (straight or diagonal) and hops over another piece to the next square beyond. Created in 1925, Dawson's nightrider extends the knight's move in a straight line. That is, the nightrider moves like the knight in an L-shaped manner two forward and one square orthogonally, either right or left. To extend the move, for example, the nightrider can also move L-shaped two forward, one right, and continue two forward, parallel to the original direction, and one right again. That maneuver extends nightrider's move like a knight in a straight line. For a nightrider centrally positioned on a board, eight lines radiate from its square for it to move along. The lines also correspond to the eight moves a knight so positioned can make. The nightrider just extends the knight's move to two or more simple knight moves tacked on one another in the same direction.

Dawson presents these pieces for puzzles to solve in chess problems. In Dawson's games, grasshopper substitutes for bishop, or nightrider substitutes for knight, on an eight-by-eight board. The greater versatility of these pieces creates more possibilities of play, even on a conventional board. Alongside orthodox pieces, these more powerful pieces diminish greatly the strategic value of pawns especially.

U.S. Pat. No. 5,421,582, Jun. 6, 1995, to Carl E. Ritter, discloses a modified chess game played upon a large octagonal board. This version of chess introduces a new piece, a viceroy, with a new manner of movement. The viceroy moves two squares at a time in the same straight or diagonal direction. The move is two-square, like the knight, but without the knight's change of direction. Thus, the viceroy is capable of eight possible moves from a centrally located square. The game retains the six orthodox chess pieces and otherwise follows most of the standard rules of chess. Two viceroys for each side multiply the number of options of play, and the large board of one hundred thirty-six squares encourages indirect, diversionary play. However, the distant spacing of pawns, separated by nine squares to start the game, detracts from their value. Therefore this variation alters the relative valuations of major pieces to pawns and, in turn, changes the balance and dynamics of chess.

U.S. Pat. No. 4,033,586, Jul. 5, 1977, to Michael J. Carinthios, discloses a variation called Grandchess. It is played on a nine-by-nine board with the elimination of the queen as such and the introduction of two princes for each side. The prince moves the same as the ordinary queen. All the bishops are on the same-colored squares, (white) so that half the squares can never be reached by the bishops. Grandchess' larger board creates more possibilities of play and a new strategy, where play of other pieces concentrates on squares the bishops cannot reach. (black) However, this disruption in a side's two bishops' ability between them to cover all the squares really limits strategy, rather than expands it.

Created in 1899 by Ben R. Foster (U.S.A.), Chancellor Chess has a nine-by-nine board and one new piece for each side. A chancellor can move either as a rook or as a knight in one play. With symmetrical initial positioning, all the bishops start on the same-colored squares again, like in Grandchess. A requirement that one bishop be positioned between knight and rook would avoid this difficulty. On balance, this game adds a major piece, the chancellor, that necessarily detracts from the pawns' and other minor pieces usefulness.

In the 1920's, world chess champions, Jose Raul Capablanca and Emanuel Lasker together advocated an expansion of chess, now termed Capablanca Chess. This variant entails adding two new pieces for each player, one between each knight and bishop, on an eight-by-ten board. A chancellor moves either like the rook or the knight, and a cardinal moves either like the bishop or the knight. For the sake of a more complex game, a surfeit of powerful, combined moving capability tilts the balance again to major pieces.

U.S. Pat. No. 5,511,793, Apr. 30, 1996, to James S. Watt and Hi Kapaa, discloses variations of chess on square boards ranging in size up to twelve by twelve. New pieces obtain their moving ability from combinations of four simplex pieces, rook, bishop, knight, and bowman. The bowman extends a knight's potential movement by traveling two "linear dog-legs," as the inventors term it. Bowman is the same as Dawson's nightrider for two knight-like movements in a line. Already discussed above, Dawson makes no such restriction for this chess variation, because nightrider can perform, not just two, but any number of such movements as one move.

In Watt and Kapaa's method, a composite piece can move, for one example, like either rook or bowman, at the player's option in any given turn. Without their unusual special rules, such as a pawn's ability to liberate a captured piece, the strengths of various new composite pieces detract from the traditional, subtle value of pawns. Moreover, even with the modular design proposed by this patent, composite pieces are inherently confusing as to their powers. Furthermore, on a board with ten rank rows, pawns cannot engage immediately after a pawn opening of two squares by each side, as they can in orthodox chess, further diminishing pawns' utility.

C) Chess-like games having a piece with a three-square move

U.S. Pat. No. 5,484,157, Jan. 16, 1996, to Michael H. King, discloses a military chess game upon a conventional board. Seven new pieces mostly move differently from corresponding chess pieces. Soldiers move one square any direction, unlike their corresponding pawns. Helicopters give the choice of moving either one or two squares in a straight direction. Large tanks move three squares in the same straight or diagonal direction. There is only one piece capable of traversing the board in one move, as bishop, rook, and queen all can in orthodox chess. Therefore, this game features a surplus of pawn-like or weaker pieces, with only one major piece.

A fourteenth century historical variant played in Persia, Timur's Chess utilizes an eleven-by-ten board. Only the rooks, knights, and king have moves congruent with orthodox counterparts. Eleven pawns' initial position are in the third rank, and they can never move two squares at once. Three different bishop-like pieces move respectively one square at a time, two squares at a time, and two or more at a time. Two other rook-like pieces move respectively one-square and two-square. All the foregoing moves are required to be in the same direction, and some of them include leaping ability.

Timur's Chess does not correspond closely to orthodox chess, particularly with the placement of the pawns and the preponderance of weaker pieces. Of significance about Timur's Chess are the movements of the two remaining pieces. A giraffe moves one diagonally and then three or more straight in the same general direction. A camel moves three squares, one diagonal and then two straight in the same general direction, jumping over any intervening piece. The camel's move is also described as a slant leap to the opposite corner of a two-by-four rectangle of squares. With its jumping ability, the camel really just has an extended knight-like move. A one-diagonal, two-straight move for the camel and not a one-straight, two-diagonal move for the same or a different piece evinces an assymetry that no orthodox patterns of movement have.

A thirteenth century Turkish Great Chess, played on a thirteen-by-thirteen board has a gazelle that has a one-diagonal, two-straight move also, in a game quite unlike orthodox chess. The gazette's three-square move is the same as that of Timur Chess' camel.

D) Jetan and pieces with three-square moves

Created in 1922 by Edgar Rice Burroughs, Jetan, or Martian Chess is played on a ten-by-ten game board. No piece has a role of movement just like an orthodox piece. Of interest are several different pieces' moves that are three-square. Two fliers per side move three squares diagonally in any combination of directions. Two "dwars" per side move three squares straight in any combination of horizontal and vertical directions. The rules of movement for fliers and dwars allow them to change direction once or twice in one move, at the player's option, provided that fliers travel only diagonally and dwars only straight. Since any direction is permitted, a flier even offers the option, after starting in one diagonal direction, of changing direction twice back to one of the four squares diagonally adjacent to its starting square, to complete a move. Similarly, a dwar can even double back to one of the four squares adjacent in a straight direction to its starting square. Also, these (non-jumping) pieces can advance three squares without turning at all, a flier in one of the diagonal directions, and a dwar in one of the straight directions. The flier's four three-square diagonal moves without a change of direction define the four corners of a seven-by-seven array of squares centered about a starting square. In Jetan, one chieftain for each side moves three squares in any combination and direction of both straight and diagonal steps. The result is that, on a central and unobstructed portion of the board, the (non-jumping) chieftain can reach all the other forty-eight squares within a seven-by-seven array of squares centered about a starting square. Wholly different from orthodox chess, Jetan becomes a game essentially between the two chieftains with the other pieces mostly just blocking off squares.

Nevertheless the concept of a three-square movement, implicit in Jetan, deserves further elaboration. There are eight possible movement choices, one for each straight and one for each diagonal direction, for each step of an unrestricted three-square move. That makes eight times eight times eight (8×8×8) or five hundred twelve (512) possible moves, without any obstructing pieces. However, the rules mean to prohibit passing through any square twice, including the starting square, in the course of a move. Excluding those combinations specifically, Jetan's chieftain has three hundred ninety-two (392) possible legal moves. Each of the 392 permitted moves takes the piece to one of the forty-eight squares already indicated. For example, each corner square of the indicated seven-by-seven array centered about a starting square, can be reached only one way, by three diagonal steps in the same direction. A square adjacent to the chieftain's starting square can be reached, as it happens, twelve different ways, by various permitted combinations of straight and diagonal steps. Such a feature, permitting more than one way to reach a square, has not appeared in a true chess-like variant. In contrast, all orthodox chess pieces have only one way to reach a square.

Though it is an original idea, this ability of a piece to reach squares in more than one way is implemented inconsistently in Jetan. That is, the chieftain can reach, from its starting square, the various other squares within the surrounding seven-by-seven array, by permitted combinations of its three-square move, as it turns out, in one way for the four indicated corner squares, seven ways for the four outside squares in the straight directions, six ways for the squares at the opposite corner of a two-by-four and of a three-by-three rectangle of squares, three ways for the squares at the opposite corner of a three-by-four rectangle of squares, twelve ways for the twenty remaining squares, and an additional twenty-four ways for the starting square itself, all totalling the 392 moves. Thus, there is a great amount of inconsistency, redundancy, and overlap in permitted movement patterns. The move of three squares in any direction, straight or diagonal, in any combination, with any change of direction, becomes a haphazard panoply of movement patterns and choices. Furthermore, in Jetan there is no thought to blend or harmonize a three-square move with orthodox pieces, of which there are none. As a matter of fact, by itself, the chieftain would ordinarily defeat a side of the sixteen conventional pieces. Thus, an unlimited three-square move would upset the balance and dynamics of orthodox chess, rendering conventional pieces ineffectual and trivializing strategy. Such an unrestricted three-square mode of movement belongs where it resides, in an intriguing, enjoyable sideshow board game, not any bona fide chess expansion.

E) Disadvantages of prior art

In attempts to create a more challenging, expanded chess-like game, the examples of prior art above suggest some problems to be addressed. Because of the long history of chess and study of previous games, many chess strategies are well-known and outcomes of scenarios of play all too predictable. One result is that computer programs are able to beat all but a few of the best players. Even before the present computer age, inventors of chess-like games have been motivated to alter orthodox chess in a novel way. The goal has been to reclaim the original game's unexpectedness or spontaneity, wherein many strategies are still unexplored.

Nonetheless, orthodox chess has been successful for about five hundred years as the most popular of games. Therefore, ideally, an expanded variation should specially preserve the spirit and most essential dynamics of the original, while it multiplies the possibilities of game positions in a unique way. In this regard, an optimal re-design should retain an interplay of chess pieces with about the same balance of forces as orthodox chess, thereby keeping its longstanding, widespread appeal. Andre Danican Philidor, the most famous chessplayer before the present era, stated in his eighteenth century treatise, *Analyze du Jeu des Echecs,* that the pawns are the essense of the game, a recurrent idea. Introduction of a new piece, rule, or board must delicately expand the orthodox method and not over-develop pieces of combined powers of movement.

As mentioned, many attempts at revision have weakened the value of pawns too much, in comparison to new or stronger pieces. In contrasting approaches, a few variants have created too many pawn-like pieces or otherwise changed the rules to an extreme. Examples of the latter are those using an octagonal board or a board as large as twelve by twelve, or those that change the rules of movement of most of the pieces, or even all of them. In all these cases, time-tested dynamics of the orthodox game are hardly recognizable.

New pieces in chess variations of prior art have fallen into two main groupings. One group of pieces exhibit the combined capabilities of two orthodox chessmen, such as a choice of movement like a knight or a rook. The second group just restricts or truncates the move of some one particular orthodox piece. In example of the latter, prior art has created queen-like pieces that move only two squares or only three squares in any one of the eight possible directions. The creativeness in such pieces lies only in keying off one or two classical pieces for altered rules of movement. These are not really new departures to expand with a piece having an original movement in its own right. There has been no bold step to extend chess for what new times demand, a multiplicity of new game positions that also keep the fundamentals intact.

A few variants have utilized pieces with moves that are three squares. King's military chess game has a piece, the large tank, that moves along queen-lines, becoming essentially just a restricted or limited orthodox piece. A centrally positioned and unobstructed large tank can reach eight possible squares. Timur's Chess utilizes a three-square movement for one piece, the camel, consisting of one diagonal step and two straight steps continuing in the same direction, making for two distinct movement patterns. No provision is made for other combinations totalling three squares, such as one straight and two diagonal. Counting the four diagonal directions a camel's move can start along and the two straight directions for continuation that are possible, the camel has eight different moves. Thus, a centrally positioned camel can reach eight possible squares, the same number as the large tank of King's military chess game.

A move of three squares is intriguing because it is of intermediate range. In orthodox chess, at one extreme are the king, the pawns, and the knights, that all move less than three squares. At the other extreme are the bishops, rooks, and queen, that all can move more than three squares. A movement pattern of some intermediate range, like three-square, is more likely to preserve the nature and dynamics of orthodox pieces' existing interrelationships.

The extreme case of a three-square move is exhibited in Burroughs' Jetan. This game has essentially abandoned the chess format by having no bishops, no rooks, no queen, and no importance for the pawns. Its major capturing piece, the chieftain, has an unlimited three-square move, any combination or direction of either straight or diagonal steps. Effectively, the chieftain controls the seven-by-seven array of forty-nine squares centered about its position by its 392 moves.

In comparison, out of the same 392 moves, just eight moves are allowed for the large tank of King's military game. Eight different moves out of the 392 are allowed for the camel of Timur's Chess. As yet, no variant has implemented three-square movement patterns as a creative, limited, well-defined move that complements orthodox pieces in a balanced way.

All in all, prior art reveals that innovations of board size and rules of movement, in various combinations, some including new pieces, have failed as yet either to raise chess to a higher potential or to enlarge the implicit dynamics of the orthodox version coherently and creatively.

Source material relating to prior art other than the patents already cited are as follows:

(1) H. J. R. Murray, A *History of Chess,* Clarendon Press, Oxford, England, 1913, Part 1 esp. pp. 344–348, Part 2.

(2) Henry Davidson, *A Short History of Chess,* McKay, New York, N.Y., 1981.

(3) John Gollon, *Chess Variations,* Charles E. Tuttle Co., Rutland, Vermont & Tokyo, Japan, 1968, pp. 73–79, 86–89, 209–217, p. 219 ff.

(4) Harry Golombek, *Golombek's Encyclopedia of Chess,* Crown Publishers, New York, N.Y., 1977.

(5) British Chess Magazine, vol. 16, 1951, pp. 78–79, pp. 137–138 (letters about T. R. Dawson).

(6) British Chess Magazine, vol. 15, 1950, "Problem World," by T. R. Dawson, pp. 73–74.

(7) United States Chess Federation, *Official Rules of Chess*, McKay, New York, N.Y., 1978.

OBJECTS AND ADVANTAGES

Accordingly, several objects and advantages of the present invention are:

(a) to create an expanded chess-like game on a larger game board with a new piece, capable of a unique mode of movement, that complements the orthodox pieces;

(b) to implement the new piece's way of moving as three-square, consisting of a specified set of choices of movement patterns, including both straight and diagonal steps;

(c) to let the new piece have three alternative ways to move to any reachable square;

(d) to disclose an improved variant of chess with the new piece's forking potential unmatched by any orthodox piece;

(e) to expand ordinary chess to the eight-by-ten board size in such a way that the importance of the pawns is not diminished;

Further objects and advantages are to increase the variety of game positions in chess, thereby making human players better matched with computers for a long time, and to re-institute an old form of castling, free castling, more compatible with the expanded eight-by-ten board size. Still further objects and advantages will become apparant from the descriptions of the drawings and the preferred embodiment.

SUMMARY

The present invention is a creation of a chess-like game played upon a game board with ten file rows and eight rank rows. Both black and white sides have two falcons, new pieces with novel three-square advancement patterns. A falcon's move is executed from a particular set of choices requiring both straight and diagonal movements, totalling the three squares. The non-jumping move reaches precisely those squares that neither queen nor knight can reach with the pieces centrally positioned within a seven-by-seven array of squares.

Reference Numerals in Drawings

| | | | |
|---|---|---|---|
| 24 | Falcon Chess | 25 | game board |
| 26 | light-colored squares | 27 | dark-colored squares |
| 28, 28A | falcon | 30, 30A | king |
| 32, 32A | queen | 34, 34A | rook |
| 36, 36A | bishop | 38, 38A | knight |
| 40, 40A | pawn | | |

DESCRIPTION OF THE PREFERRED EMBODIMENT

The Initial Set-up

Figure 1:
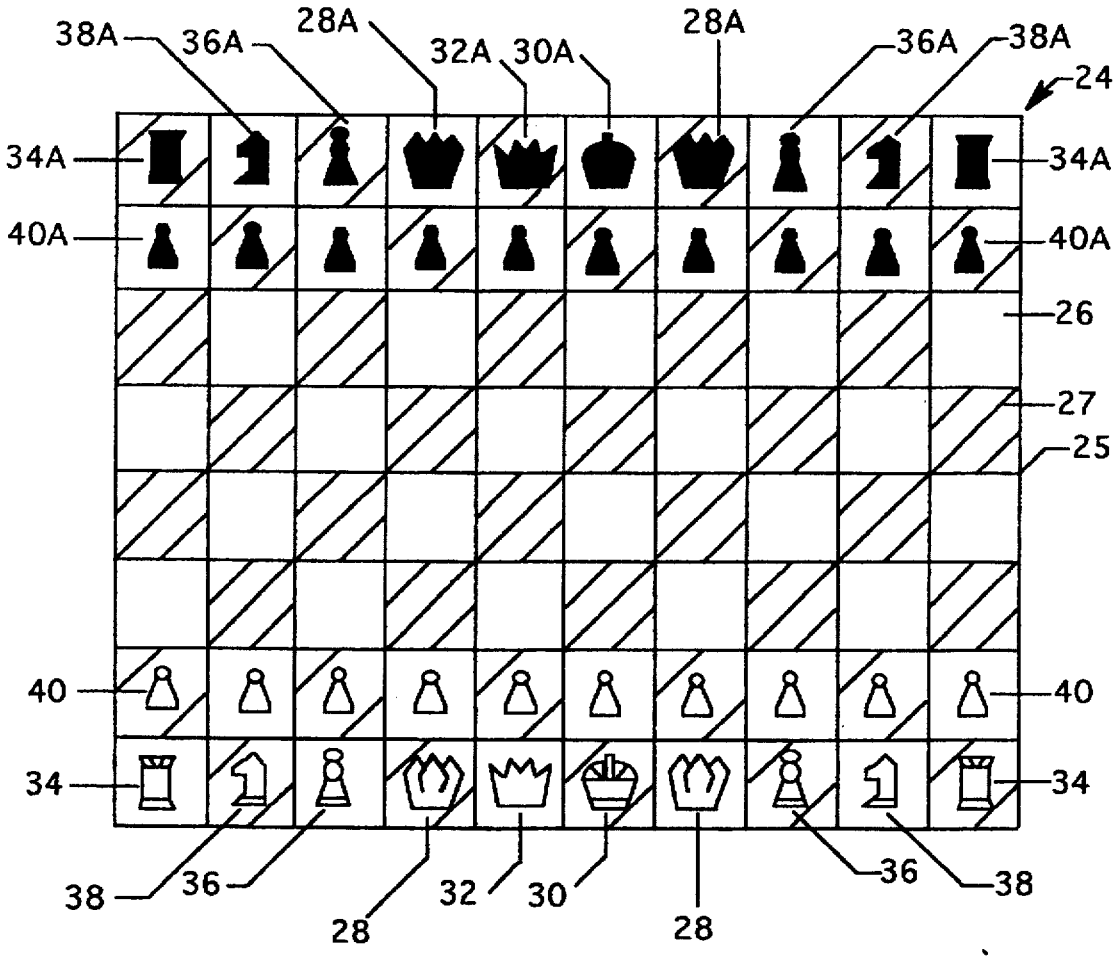
FIG. 1 is a plan view of the new, expanded chess game, showing the initial positions of the pieces on the game board.

FIG. 1 illustrates the initial position for this expanded chess-like game, called Falcon Chess 24 for ease of reference. The game board 25 has a playing field of eighty alternately light-colored squares 26 and dark-colored squares 27, arranged in the customary checkerboard pattern of bilaterally alternating colored squares throughout. The rectangular game board 25 can be manufactured out of wood, cardboard, or other suitable material, with the shape and pattern of the required playing surface displayed or fashioned thereon. Compared to orthodox chess, Falcon Chess 24 has two additional files, as the vertical rows of squares are called, making the board size eight by ten, with eight rank rows and ten file rows. In the preferred embodiment, a dark-colored square 27 is in the righthand lowest or closest corner, as either player faces his pieces. Each square is offset with respect to the similarly colored square of the adjacent row, and each row has alternately light-colored squares 26 and dark-colored squares 27, to form the checkerboard pattern. The playing pieces are typically white, or light-colored, for one player and black, or dark-colored, for the other player, and in turn the players themselves are referred to as white and black, and also as the two sides.

Figure 1A:
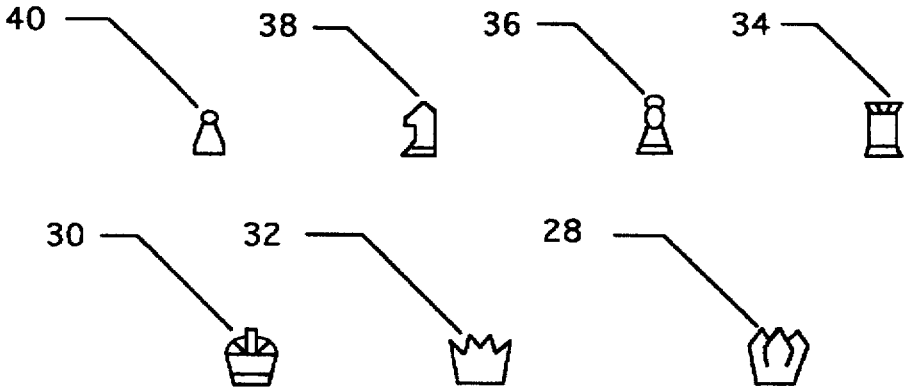
FIG. 1A is a designated illustration of each Falcon Chess piece, a pawn, a knight, a bishop, a rook, a king, a queen, and a falcon.

Referring to FIG. 1A, a set of standard playing pieces from the orthodox game, all of which are also utilized in Falcon Chess, is shown as a king 30, a queen 32, a rook 34, a bishop 36, a knight 38, and a pawn 40. As a falcon 28, a new, separate game piece is shown, visually distinguishable from the others. FIG. 1A shows these seven different pieces as light-colored, or white, and there is a corresponding set of dark-colored, or black, pieces. Any black piece is indicated by the same reference numeral for the piece, together with an 'A'. At times, in the description of the preferred embodiment and operation below, a rule or effect discussed with respect to a white piece, (without an 'A' in a reference numeral) obviously applies to a black piece also.

All the pieces from orthodox chess carry over to Falcon Chess and, in addition, there are two of the new falcon piece for each player. As shown in FIG. 1, a falcon 28, 28A for each player is situated, to begin the game, between a queen 32, 32A and a bishop 36, 36A. A second falcon 28, 28A for each player is situated between a king 30, 30A and a second bishop 36, 36A. Each side then has two falcons, so that two white and two black falcons are added to the orthodox chess pieces. Also two additional pawns 40, 40A are provided for each side, positioned in front of each falcon. The new falcon piece is designed to look like a falcon, and the standard chess pieces and the new falcon pieces can be made out of clay, wood, marble, plastic, or other suitable material, in any of a number of manners that are well-known in the art of chess set manufacture.

Shown in the initial positioning of FIG. 1, pawns 40, 40A, ten for a side now instead of eight, occupy the second rank, as in the ordinary game. Two rooks 34, 34A for each side have their placements similar to the orthodox version at the corner squares of the first rank. Two knights 38, 38A for each side have their position medially one square from the corner squares in the first rank. Then bishops 36, 36A appear two squares removed from the corner squares in the first rank, all shown in FIG. 1. As in orthodox chess, queen 32, 32A occupies the square of its corresponding color nearest the center of the first rank row, and king 30, 30A occupies the central square next to the queen. That is, to start the game, white queen 32 rests on a light-colored square 26, and black queen 32A rests on a dark-colored square 27. From either player's view of her pieces, the first or nearest rank row consists of ten pieces, one on each of the squares, two rooks, two knights, two bishops, two falcons, one queen, and one king. The ten pawns in the player's second row complete the set of pieces for the side. In corresponding placement at the other end of the game board 25 are the other side's (black's or white's) pieces.

The orthodox chessmen retain their customary moves in Falcon Chess 24. These were described above in the history of chess. Pawn 40 retains its variety of moves, one or two at its opening, one thereafter, capturing diagonally, en passant, and promotion to a piece of choice, except the king, upon reaching the final rank. En passant makes a pawn that moves two squares vulnerable to capture for one turn at the square it has passed over, by an opposing pawn. In the play of the game, turns alternate until a checkmate arises or a properly agreed upon draw, according to orthodox rules.

The Falcon's Move

The falcon's novel mode of movement, or pattern of advancement, is three-square, made of a combination of straight and diagonal steps. To describe moves on the game board 25, a "step" means an advance, either straight or diagonal, of one square to, or over, an adjacent square. Falcon 28 cannot jump over an intervening piece, and only a particular set, or array, of three-square moves is permissible. In general, to start a move, falcon 28 commences in any one of the four diagonal directions available, or any of the four straight (two vertical and two horizontal) directions available. That one-square advance takes the falcon over a first intermediate square. Such a step may be termed a "straight-or-diagonal" step, simply to indicate that any of the eight directions are possibilities for movement and that one straight and one diagonal are inherently of the same validity. The falcon continues a second step of one square in the same general direction over one of three squares possible, as will be explained in detail below, termed a second intermediate square. The falcon concludes the move in another step of one square to one of two squares possible for its third, final square, as will be explained in detail. The two intermediate squares must be free of any other piece for the falcon to pass over. The foregoing is a general description of the falcon move.

In particular, falcon 28 must always combine two straight and one diagonal, or else two diagonal and one straight. The two straight, or rectilinear, steps in a given move must be in the same direction. Likewise, in the other variety of move, the two diagonal, or slant, steps must be in the same direction. That is, no change of direction of ninety degrees is permitted in the course of the move of three squares. This requirement is the first half of a direction rule for the falcon move.

Figure 2:
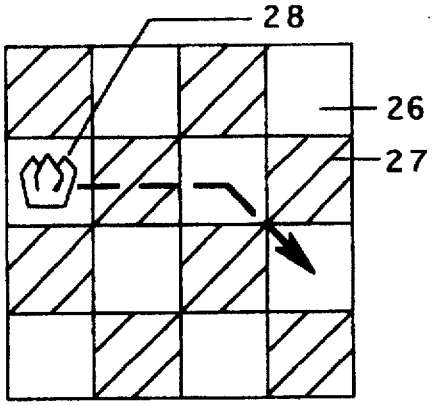
FIGS. 2 through 13 each show one distinct movement pattern permitted for the falcon upon a portion of the game board.
Figure 3:
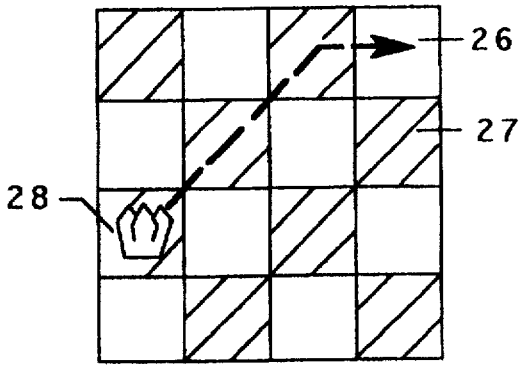

FIG. 2 through FIG. 7 show six legal falcon moves within the rules being described. In each of FIGS. 2 through 7, a move is shown on a four-by-four square portion of the game board for convenience. The falcon's move is always three squares, consisting of two steps either diagonal or straight and one step of the other. In FIG. 2, a falcon 28 moves two straight and one diagonally, or slant, at a forty-five degree angle, as the arrow shows. The change of direction from straight to diagonal must always be at a forty-five degree angle to either the square to the right or the one to the left. In FIG. 3, a falcon 28 moves two diagonal and one straight, or rectilinear, at a forty-five degree angle, as the arrow shows. In this form of the move, the change of direction from diagonal to straight must be at a forty-five degree angle to either of the two squares available. This requirement of a forty-five degree angle change of direction is the second half of a direction rule for the falcon move.

Figure 4:
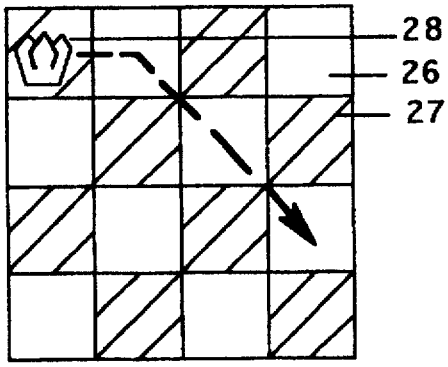
Figure 5:
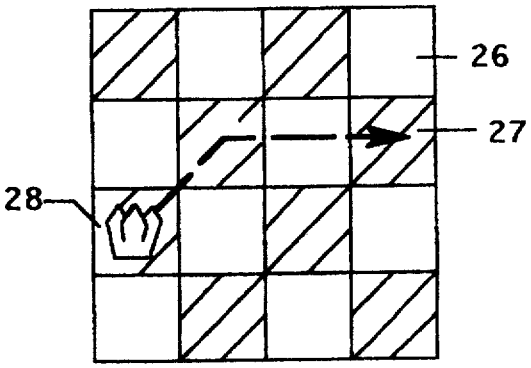

The two-square portion of the move in the same direction (either straight or diagonal) can occur as the first two steps, as in FIG. 2 and in FIG. 3. Also acceptable are the patterns where the two-square portion in the same direction are the last two steps of the three-square move. In FIG. 4, a falcon 28 moves one straight and then two diagonally, as the arrow shows. In FIG. 5, a falcon 28 moves one diagonal and then two straight, as the arrow shows. The transition from straight to diagonal or from diagonal to straight in the course of a move is always effected by a forty-five degree change of direction from the first direction of travel. Neither a change of direction of ninety degrees nor one of one hundred thirty-five degrees is permitted.

Figure 6:
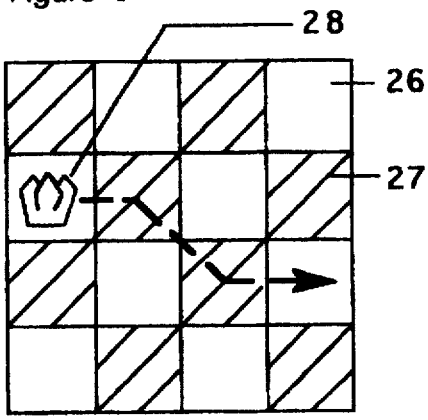
Figure 7:
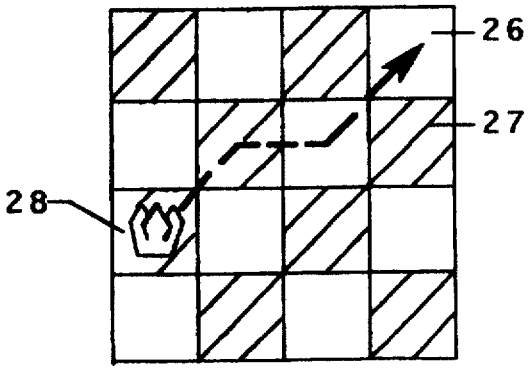

The falcon move is a pattern of advancement across two intermediate squares and terminates on a third square. Using 'S' for straight and 'D' for diagonal, there are the following acceptable patterned falcon moves, associated with the figure that represents it:

| | |
|---|---|
| FIG. 2 | S S D |
| FIG. 3 | D D S |
| FIG. 4 | S D D |
| FIG. 5 | D S S |
| FIG. 6 | S D S |
| FIG. 7 | D S D |

In the three-lettered 'S' and 'D' notation for a move, the first step takes the falcon over a first intermediate square. The second step takes the falcon over a second intermediate square, and the third step concludes the move on its final square.

Listed above with the others and also permitted are the patterns "S D S", represented in FIG. 6, and "D S D", represented in FIG. 7. In these two patterns, the "doubled" portion of the move, straight or diagonal, occurs in the first and third steps. The pattern illustrated in FIG. 6 exhibits straight movements not continuous, but separated by an intervening diagonal step. As before, the switch, or transition, from straight to diagonal, as well as vice versa, is performed only by a forty-five degree change of direction. The final straight step must be parallel and in the same direction as the original straight step. So, as the arrow indicates for a falcon 28 in FIG. 6, this movement pattern goes straight, diagonally at a forty-five angle, and then straight in the other direction at a forty-five angle, thus ending parallel to the original direction to its final square. This form of the basic falcon move is termed a "split block," simply to indicate that the two straight steps are separated by the diagonal one.

FIG. 7 shows the legal pattern "D S D", wherein the move of a falcon 28 transpires as first a diagonal step, then a straight step by way of a forty-five degree angle turn, and finally a diagonal step parallel and in the same direction as the first diagonal step, as the arrow indicates. This form is characterized as a "split diagonal," to indicate that the two diagonal steps are separated by the straight one.

It is critical that, in all legitimate falcon moves, the two steps that are diagonal, or the two that are straight, be pointed in the same exact direction, either as a continuation or, in the forms called split block and split diagonal, as a parallel vector. All indicated falcon advancement patterns are equally correct, valid ways to move the falcon, available for a player on any turn.

All six patterns of the falcon move shown in FIGS. 2 through 7 are performed by a first forty-five degree angle change of direction to the right of the first direction travelled. In the split block case of FIG. 6 and the split diagonal case of FIG. 7, there are two changes of direction of forty-five degrees, the first change going forty-five degrees right and the second forty-five degrees left.

The mirror image versions of these same moves are shown in FIG. 8 through FIG. 13. These are all distinct movement patterns in their own right, because the forty-five degree angle changes of direction are reversed, making for different moves on the chess board. In each of FIGS. 8 through 13, as before, a move is shown on a four-by-four portion of the game board for convenience. The difference in the patterns in FIGS. 8 through 13, compared to those of FIGS. 2 through 7, is whether the first forty-five degree angle change of direction is right or left. In FIGS. 8 through 13, each pattern, designated by an arrow, has a first forty-five degree angle change of direction to the left of the first direction travelled. For example, in FIG. 8, a falcon 28 moves straight two squares in the same direction, then angles left forty-five degrees to its third, final square, as the arrow shows.

Figure 8:
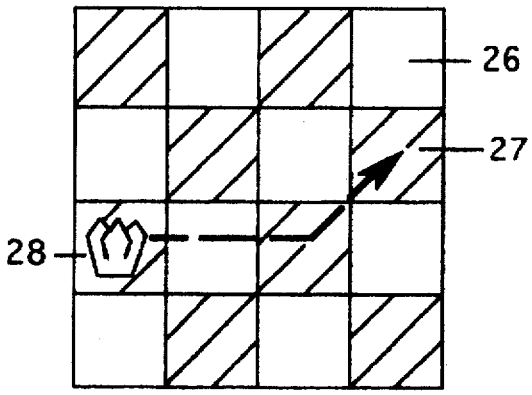
Figure 9:
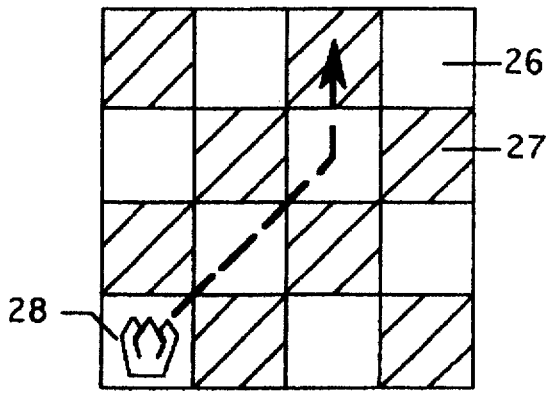
Figure 10:
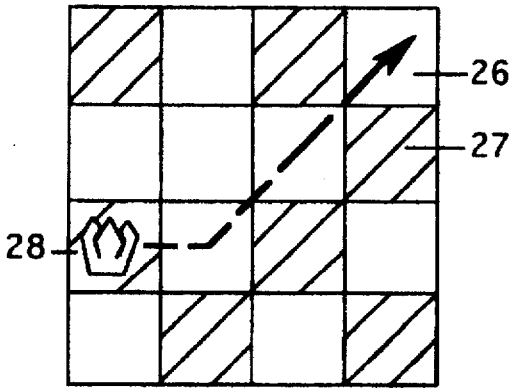
Figure 11:
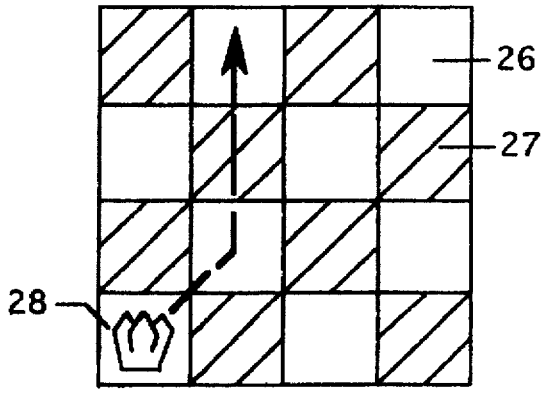
Figure 12:
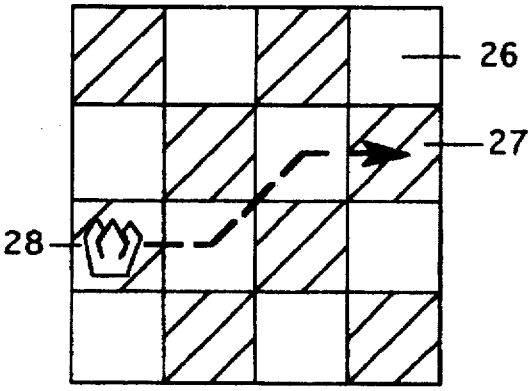
Figure 13:
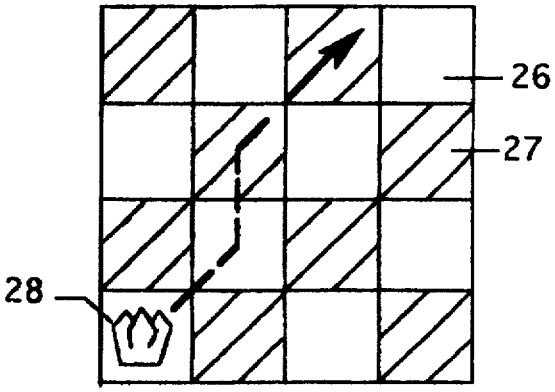

All six falcon moves, represented by the arrows, in FIGS. 8 through 13 are the required three squares, composed of one or two straight, and the other(s) diagonal. The 'S', straight, and 'D', diagonal, description applied to the moves represented in FIGS. 8 through 13 is listed below:

| | |
|---|---|
| FIG. 8 | S S D |
| FIG. 9 | D D S |
| FIG. 10 | S D D |
| FIG. 11 | D S S |
| FIG. 12 | S D S |
| FIG. 13 | D S D |

Signified by the first two letters in the 'S' and 'D' notation, the first two steps go to intermediate squares. As before, these must be free of any other pieces, for the falcon to pass over to its third, final square. As in FIG. 8, in each of FIGS. 9 through 13, the move of a falcon 28, represented by the arrow, has a first forty-five degree angle change of direction to the left. All six patterns represented in FIGS. 8 through 13 utilize only forty-five degree angle turn(s), or transition(s), from straight to diagonal, and vice versa, and also the doubled part (straight or diagonal) of the three-square move is in the same direction. Following those two criteria is sufficient to meet the full direction rule for the falcon. Therefore, these movement patterns in FIGS. 8 through 13 are six more valid moves.

Adding the six additional movement patterns of FIGS. 8 through 13 to the six movement patterns of FIGS. 2 through 7 make twelve discreet falcon moves. All twelve basic moves are always available to a player as a game proceeds. In practice, the player is guided by the simple rules of movement of the falcon, not by the twelve alternative patterns themselves. Because the falcon cannot jump over another piece, having as many as twelve patterns is important in play.

In every falcon move, there are either one or two angled changes of directions of forty-five degrees. For ease in defining the move in some contexts, a transition from straight to straight, and one from diagonal to diagonal, that is, two continuous steps in the same direction, is strictly speaking also an angled change of direction, in this case of zero degrees. However, in describing the falcon move in the preferred embodiment, this zero degree change of direction is implicit in describing two continuous steps (straight or diagonal) in the same direction. There is no specific mention of a zero degree change of direction with respect to the basic falcon movement patterns, shown in FIGS. 2 through 13. Thus, every move has really two angled changes of direction, the one from the first step to the second step, and the one from the second step to the third step, even if one of them is a zero degree one. Furthermore, every falcon move has two different angled changes of direction from the following possibilities: forty-five degrees left, forty-five degrees right, and zero degrees. Thus, the two angled changes of direction are never the same in a permitted move. However, in describing the moves in the preferred embodiment and operation, any zero degree change of direction, or transition, that occurs, is usually not mentioned explicitly. Any reference to a move's having only one change of direction altogether, (a forty-five degree one, either to the right or to the left) more accurately means that the move's second change of direction is one of zero degrees.

Figure 14:
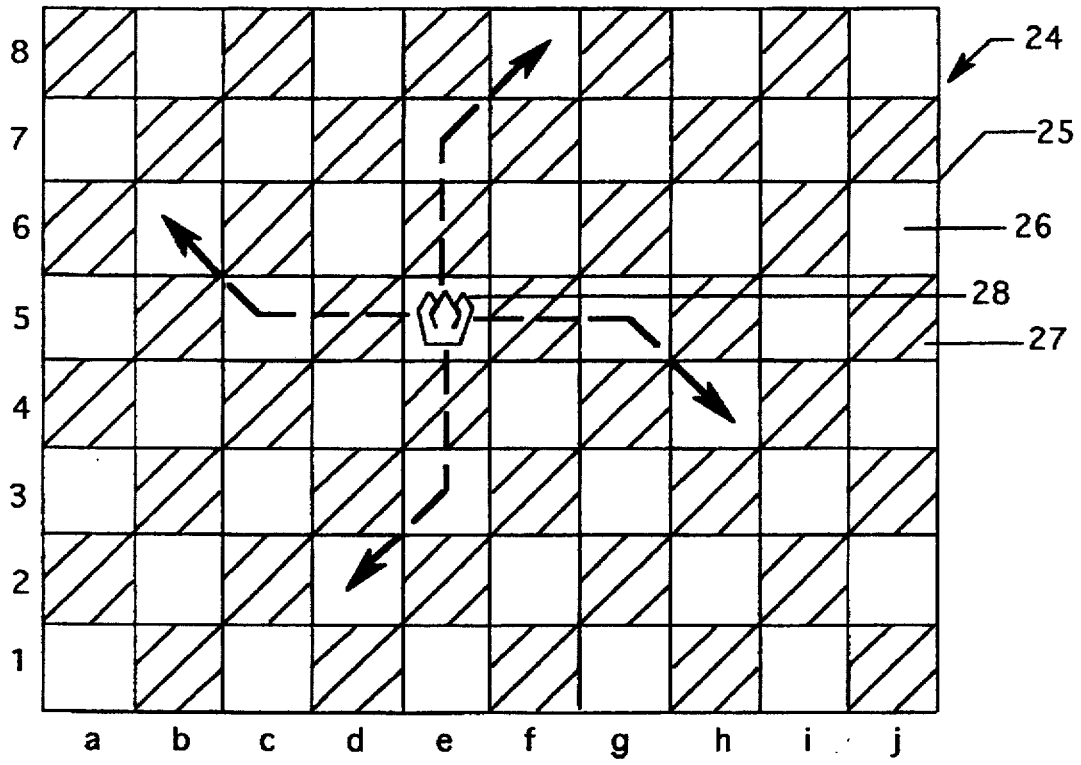
FIGS. 14 and 15 are plan views of the new chess game, each showing the four squares a specific falcon movement pattern reaches on the game board.

For ease of reference, henceforth, rank rows (horizontal) and file rows (vertical) are referred to by the designations shown in FIG. 14. Files are referred to by letter designation, 'a', 'b', 'c', 'd', 'e', 'f', 'g', 'h', 'i', and 'j', adding two letters to the orthodox chess usage. Ranks are referred to by numerical designations, '1', '2', '3', '4', '5', '6', '7', and '8'. For convenience, all references are customarily from white's perspective. A logical algebraic notation derives from this naming of ranks and files, to indicate any particular square of the eighty on the board, For example, in FIG. 14, a falcon 28 is positioned at square e5 for its starting square.

Figure 15:
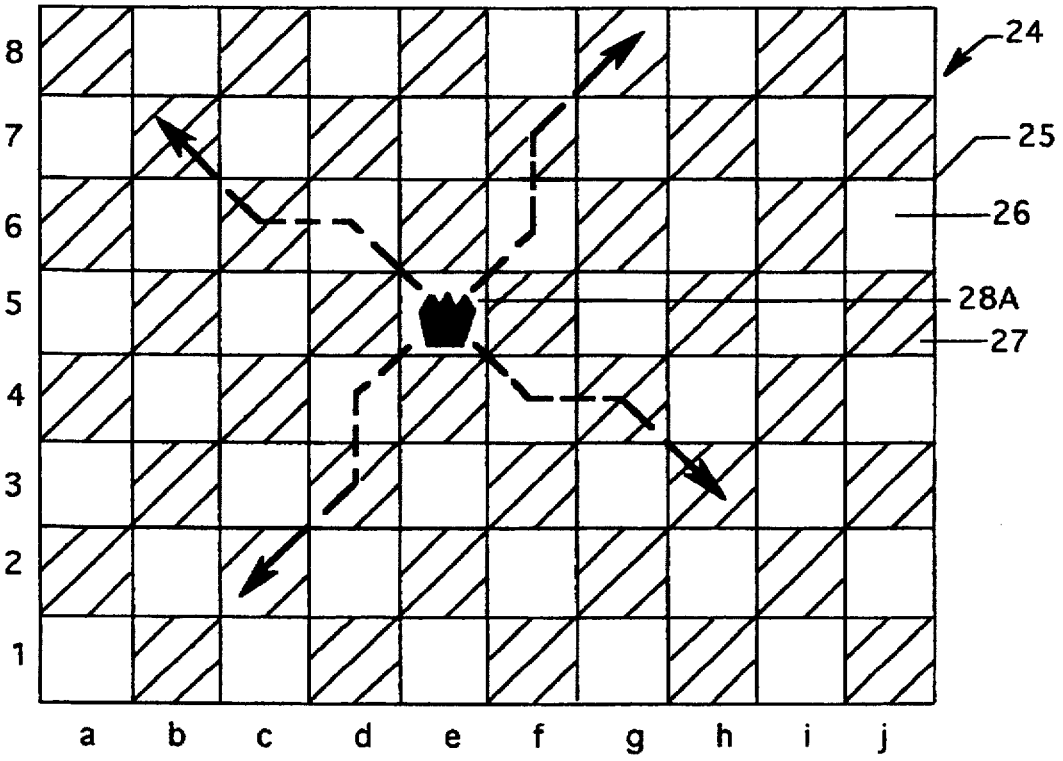

From a centrally positioned square, any one specific pattern of movement of the twelve available can be used actually to reach, not just one, but four possible squares. FIG. 14 shows one of the twelve patterns for falcon 28 positioned at e5. The movement pattern can be characterized as "S S RD". The additional notation, 'R' for right, or 'L' for left, simply tells whether an angled change of direction of forty-five degrees is right or left. Depending to which of the four available straight directions its move commences, falcon 28 in FIG. 14 can reach f8, h4, d2, or b6, any of four different squares, by pattern "S S RD", as each arrow shows. FIG. 15 illustrates another pattern of the twelve possible for a falcon move. This movement pattern is "D LS RD", as each arrow shows. Commencing from square e5, consistently following only this pattern, a falcon 28A can reach not just one square, but any of the squares g8, h3, c2, or b7, four possibilities. Each of the twelve movement patterns can be used to reach four possible squares, just as FIG. 14 illustrates for one of the patterns and FIG. 15 illustrates for another. To be able to reach any of four squares by one distinct pattern, the falcon must be centrally positioned, and other pieces must not obstruct in such a way as to prevent a move.

Figure 16:
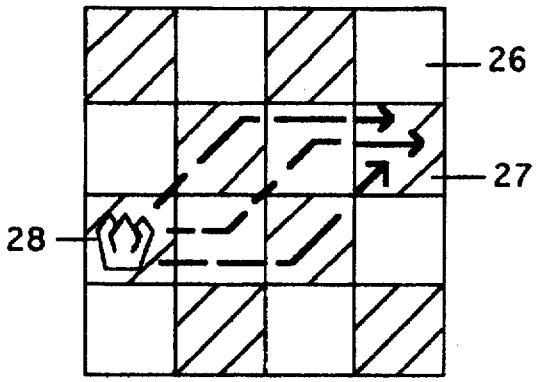
FIGS. 16 and 16A each show three ways the falcon can move to a given square upon a portion of the game board.
Figure 16A:
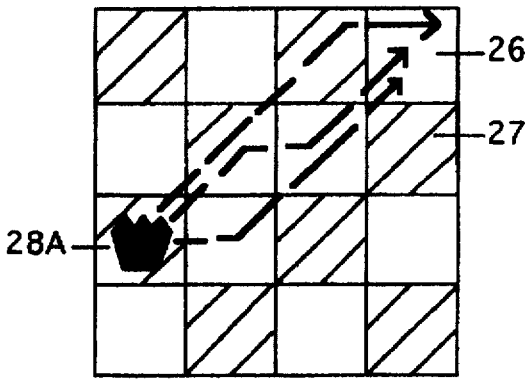

Any one square the falcon can reach from another square can actually be attained three different ways. FIG. 16 illustrates a falcon 28 using three different movement patterns to reach the same target (dark-colored) square 27. From its starting square, falcon 28 can move "D RS S", or "S LD RS", or "S S LD", as the arrows show. In simpler notation, "D S S", "S D S", and "S S D" indicate the three patterns useable legally to reach square 27 from the position shown. Thus, the falcon has a triple option of patterns to move to a square. In another example, FIG. 16A illustrates three ways a falcon 28A can reach a given (light-colored) square 26. These are "D D RS", "D RS LD", and "S LD D". More simply, "D D S", "D S D", and "S D D" are all three equally proper ways for falcon 28A to reach square 26 from its starting position for the move.

There is always this three-fold way for the falcon potentially to reach the attainable square 26, 27. Any square to which the falcon can move is reachable by some combination of three, and only three, of the twelve available movement patterns. As explained, the choices of movement pattern available all fall within the general rule of the falcon move. That move is a two-straight, one-diagonal one, or it is a two-diagonal, one-straight one, for a total of three squares, provided both that the doubled portion is in the same direction, and that any transition from straight to diagonal, and vice versa, is by a forty-five degree angle.

The new falcon piece with its novel move takes its place alongside the standard pieces on the expanded game board 25 of eight by ten, instead of orthodox chess' eight by eight. With turns alternating between the two players, Falcon Chess 24 is played in accordance with orthodox rules of chess regarding moves of the standard pieces, capture, check, illegal positions, and checkmate. (Under illegal positions, the king cannot move into and must move out &check.) The rules of the orthodox game of chess are well known to those who play chess, and *Official Rules of Chess* by the United States Chess Federation is a suitable reference for these rules. The differences between the rules of orthodox chess and Falcon Chess emanate from the new game's larger board and especially from the method of movement of the falcon itself.. Another difference is that in Falcon Chess, unlike standard chess, the procedure known as castling permits a choice of squares to which the king and the rook can move, as will be explained below.

The Falcon's Move Revisited

Figure 17:
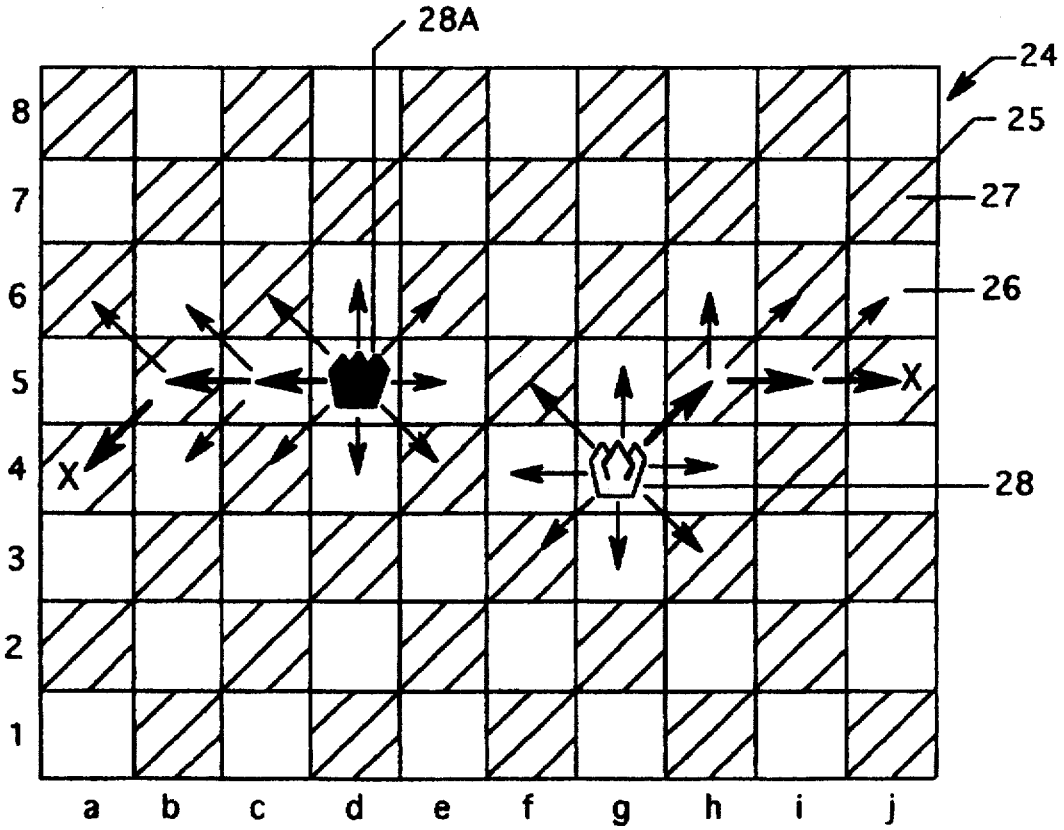
FIG. 17 shows advancement patterns of two falcons, according to the "eight-three-two" description, upon the game board.

From another perspective, the falcon's move can be described as shown in FIG. 17. All the arrows in FIG. 17 represent movement choices available from a point in the falcon's move. The smaller arrows all indicate valid movement choices that the player does not happen to select in the examples of two complete moves, those to the two X-marked squares, a4 and j5. In FIG. 17, the move of a falcon 28 commences from square g4 as a first straight-or-diagonal step in any of the eight possible directions, as shown by the arrows. The player chooses one of the eight, indicated by the larger arrow, in this case moving falcon 28 to h5, its first intermediate square. Now only the three directions, shown by the arrows, are permitted to continue the move. The three possibilities are the ones in the same general direction, with a change of direction either forty-five degrees right, or zero degrees as no change, or forty-five degrees left. In this case, the player chooses the one to i5, as indicated by the larger arrow, the second intermediate square, For the third step, only two directions are permitted, as shown by the arrows. A move to j4 is not permitted, because a second turn of forty-five degrees right in the same move is forbidden. That prohibition has the exact same effect as the first half of the direction rule, which necessitates the two straight steps (or two diagonal steps) be in the same direction. Between the other two choices in the same general direction, in this case the player chooses j5, as the larger arrow indicates, the final square of this move. Thus, falcon 28 moves from g4 to j5 by way of two intermediate squares, h5 and i5. After reaching the second intermediate square, i5, the player can move to j6, instead of j5, if desired, for a complete and legal falcon move, because a turn of forty-five degrees left after a turn of forty-five degrees right is permitted. Such a return to the original direction of travel means the two straight (or two diagonal) steps are in the same direction, although split into the first and the third steps of the move.

In another example in FIG. 17, out of the eight choices initially, a falcon 28A moves from d5 by a first straight-or-diagonal step to c5, its first intermediate square, as the larger arrow shows. Then, out of the three choices now available, falcon 28A moves to b5, indicated by the larger arrow, its second intermediate square. Then the third step offers two choices, but not the one to a5. A move to a5 is invalid because at least one square advance must be diagonal. Between the other two choices in the same general direction, in this case the player chooses a4, the final square of the move. In this example of the move of falcon 28A in FIG. 17, seven smaller arrows from square d5 represent choices of first straight-or-diagonal steps available from d5 that the player does not happen to pick. Likewise, the two smaller arrows from square c5 are choices not selected. The falcon move must be three squares, in the prescribed manner, and neither a one-square nor a two-square advance is allowed for a complete move. A move from d5 to a6, instead of a4, represents the final step of another legal three-square falcon move, which the player did not happen to choose in this case.

In FIG. 17, falcon 28A moves from d5 to a4 by the advancement pattern shown, and falcon 28 moves from g4 to j5 as shown. FIG. 17 illustrates the falcon move as consisting of eight straight-or-diagonal choices for a first step of one square, three choices for a second step of one square, and two choices for a third step of one square. This way of describing the falcon's advancement pattern may be characterized as "eight-three-two," to indicate the number of choices at each step of the move. For the second and third steps, a player must be mindful of the direction rule, in order to determine the actual squares available. Applying this "eight-three-two" description to a centrally positioned falcon, on an open portion of the board without any obstructing pieces, results in the same twelve movement patterns previously discussed and shown in FIGS. 2 through 13. This approach also discloses the aforementioned three alternative ways to reach any attainable square, shown in FIGS. 16 and 16A. Thus, the foregoing description of FIG. 17 is just an alternative, shorthand characterization of the same falcon move already explained.

Operation

The Three-fold Way

Figure 18:
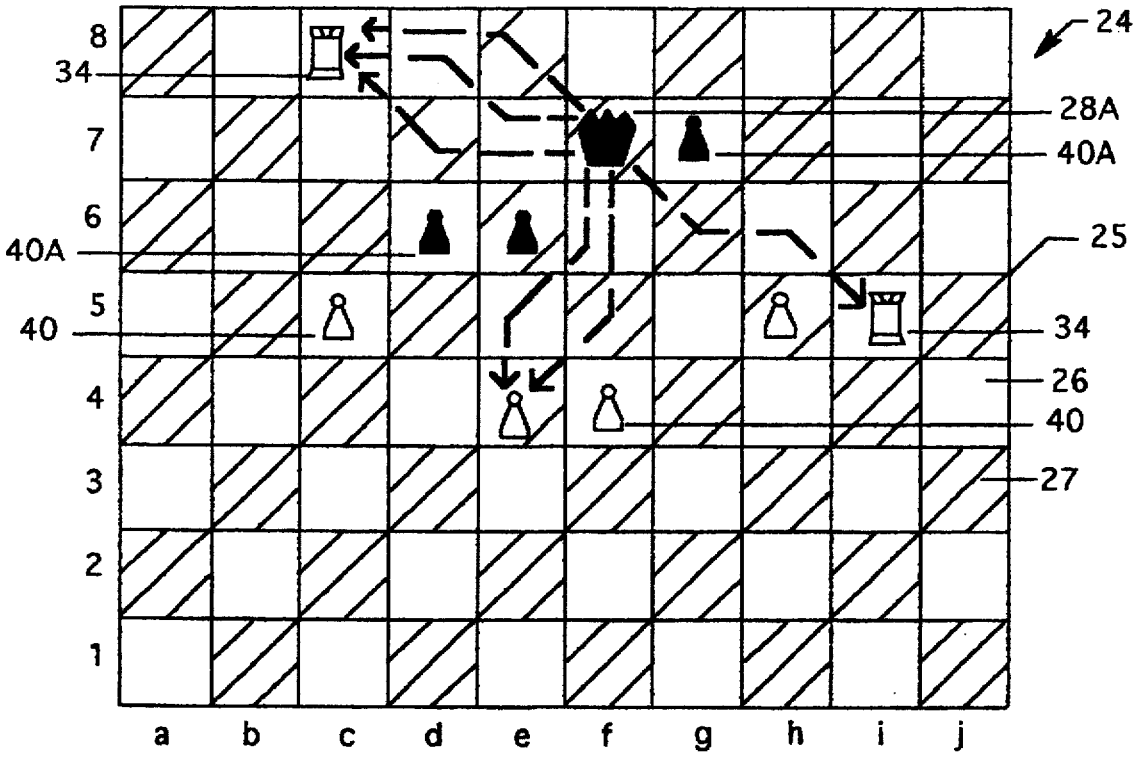
FIG. 18 is a plan view of the new chess game showing one falcon's ability to capture three different pieces, by movement patterns respectively one-way, two-way, and three-way, and also the falcon's inability to capture other pieces.

FIG. 18 illustrates various falcon movements, although it does not fully represent a game position, because the kings and any pieces nonessential to the following discussion are omitted. Since the falcon cannot jump, the two intermediate squares must be clear for a move to work. One piece intervening between the falcon's initial square and a target square makes only one or two of the three movement patterns useable. Two intervening pieces mean only one way is available, or the move may not be performed at all. For example, in FIG. 18, a falcon 28A at f7 can capture a rook 34 at i5. Because of the position of intervening pieces, only the pathway from f7 over g6 over h6 to i5 is possible, as the arrow shows. By that "split diagonal" pattern of movement, falcon 28A captures rook 34 in a legitimate falcon move. The other two ways to get to square i5 are blocked off by a pawn 40A at g7 and a pawn 40 at h5. In FIG. 18, falcon 28A can capture a white rook 34 at c8. No pieces intervene, and it is immaterial by which of the ways available, shown by arrows, falcon 28A advances to c8 in a capture. Falcon 28A can capture a pawn 40 at e4 by the two alternative pathways shown. The third way is blocked by a black pawn 40A at e6. Falcon 28A cannot capture a pawn 40 at c5, because two pawns block the way. If either a pawn 40 at d6 or pawn 40 at e6 were removed, this threat of attack would exist by an acceptable falcon move. Falcon 28A cannot take a pawn 40 at f4 because there is no legitimate falcon move from f7 to f4. In the required three steps, such a movement would entail either three straight steps, illegal for a falcon move, or improper changes of direction. The consequence of a player's actual move of the falcon is not affected, of course, by whether only one, or two, or all three patterns are available. Like any chess piece, the falcon just moves to another square, according to its rules of movement, and captures an opposing piece, if occupied.

The Sixteen Squares

Figure 19:
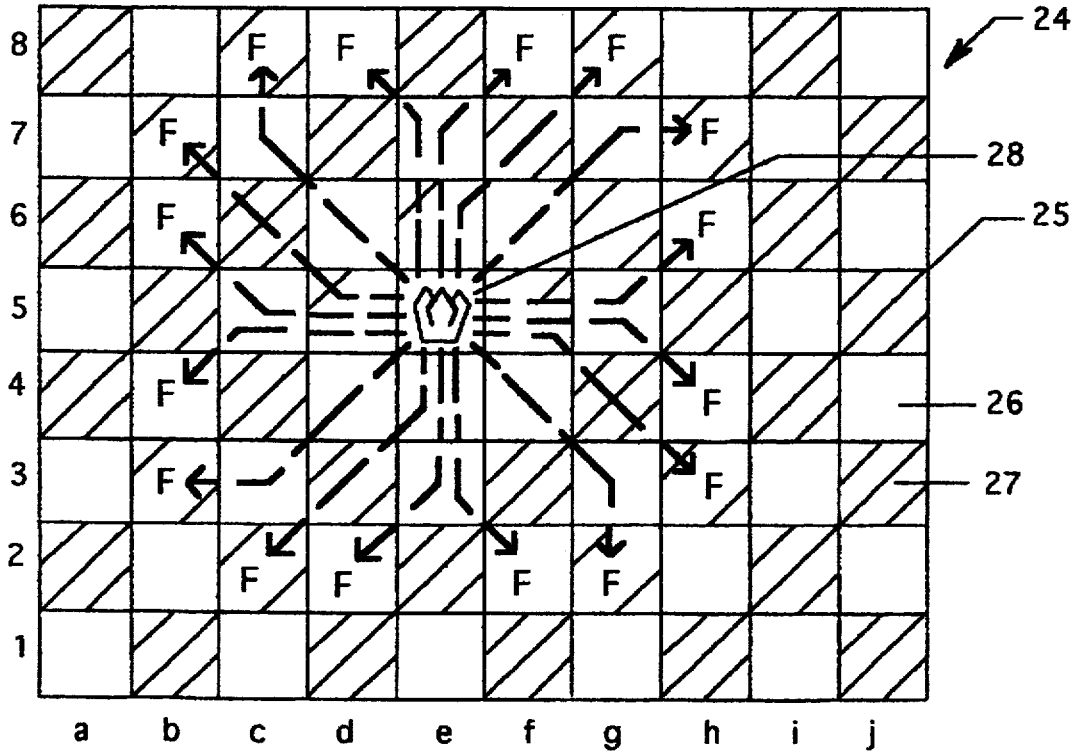

FIG. 19 shows that a falcon 28 centrally positioned on the eight-by-ten game board can reach any of sixteen squares. Falcon 28 at square e5 can reach, as shown by the arrows, squares g8, f8, d8, c8, b7, b6, b4, b3, c2, d2, f2, g2, h3, h4, h6, and h7, all marked with an 'F'. A player has the choice of moving falcon 28 to any of those squares. Any of the F-marked squares can be reached from square e5 by falcon 28 three different ways, according to the falcon's method of movement. However, for simplicity, only one of the three ways to reach each square is shown by the arrows in FIG. 19.

It is possible then for falcon 28 in FIG. 19 to reach all sixteen squares marked by 'F' from square e5 three distinct ways. Any square the falcon can reach can be done by three of the twelve movement patterns. In an actual game position, some alternative ways to reach a square may be blocked by pieces of either color, as already discussed and illustrated by FIG. 18. In fact, in the course of play, many or even all the squares themselves for the falcon to move may be blocked by the positioning of intervening pieces.

That a centrally positioned falcon can reach sixteen squares, as shown in FIG. 19 was implicit in the prior discussion. To review, FIGS. 2 through 13 show twelve legitimate falcon moves altogether. FIGS. 14 and 15 show that any one of these movement patterns can reach four different squares. Multiplying the twelve patterns by four squares reachable yields forty-eight squares. These are not forty-eight different squares, however, because FIGS. 16 and 16A demonstrate that any attainable square can be reached three alternative ways. Therefore, forty-eight squares divided by the three ways yields sixteen distinct squares, as seen in FIG. 19.

Figure 20:
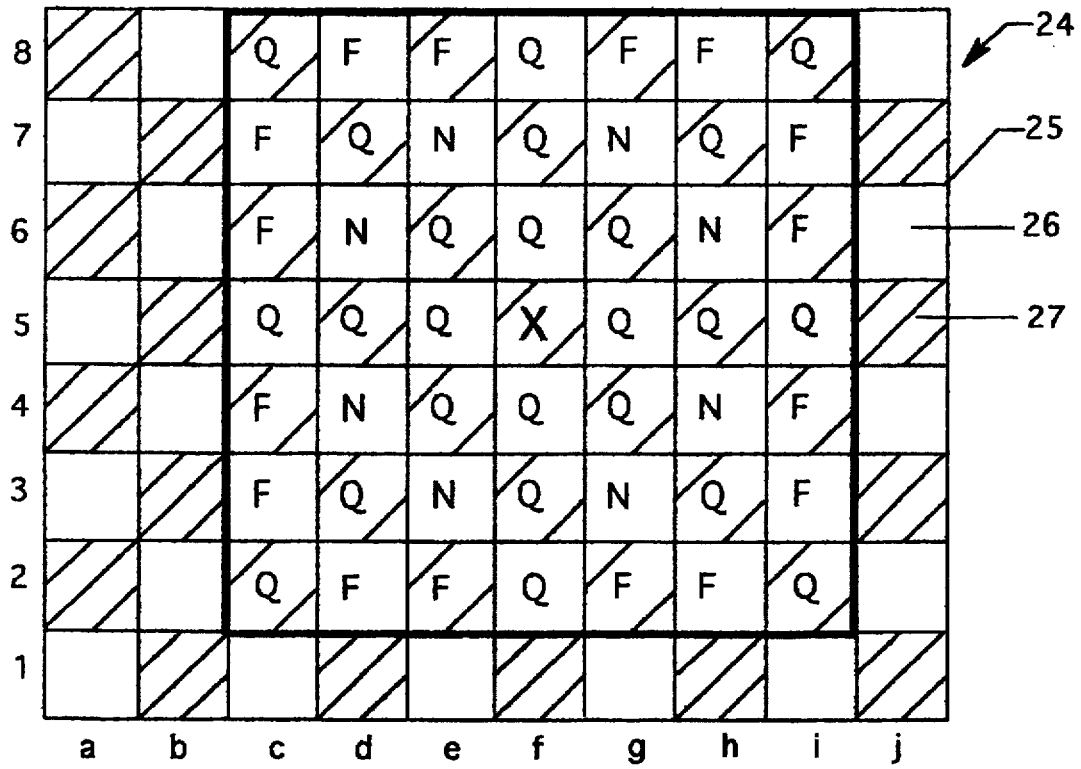
FIG. 20 is a plan view of the new chess game, indicating a seven-by-seven array of squares on the game board and which squares the queen, the knight, and the falcon can reach from the central square.

The sixteen squares that the falcon potentially can reach by its move have a special significance. In FIG. 20, the square at f5 on the game board 25 is marked with a 'X'. A seven-by-seven array of squares on the game board, centered at f5, is indicated by darker lines around the outside of those squares. The knight, positioned at f5, can reach the squares within the array marked 'N' by its move. The queen, positioned at 15, can reach the squares within the array marked 'Q' by its move. From square f5, the falcon can reach precisely those squares, marked with 'F', that the queen and the knight cannot. The falcon, as well as the knight, can reach from f5 only the squares so marked, all falling within the array. The queen, of course, potentially can move to squares outside the seven-by-seven array as well.

Strategy

Figure 21:
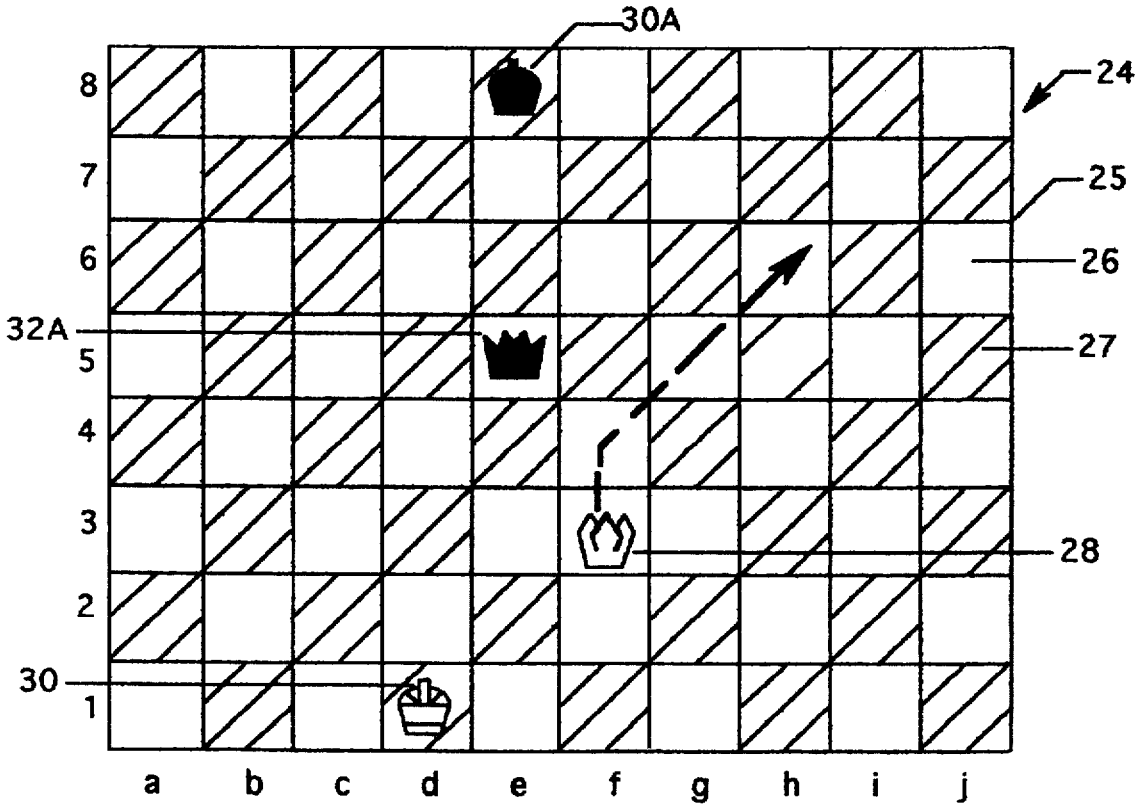
FIG. 21 shows the falcon's forking ability from a position on the game board.

One consequence of the falcon's unique move is shown in FIG. 21. The falcon's long-range forking ability is matched by any orthodox piece. In an actual game position, a white falcon 28 can capture a black queen 32A in two moves, by first moving to h6. The move to h6 both puts a king 30A in check and threatens queen 32A. On the second move, after black's move to protect king 30A, falcon 28 can capture queen 32A.

Figure 22:
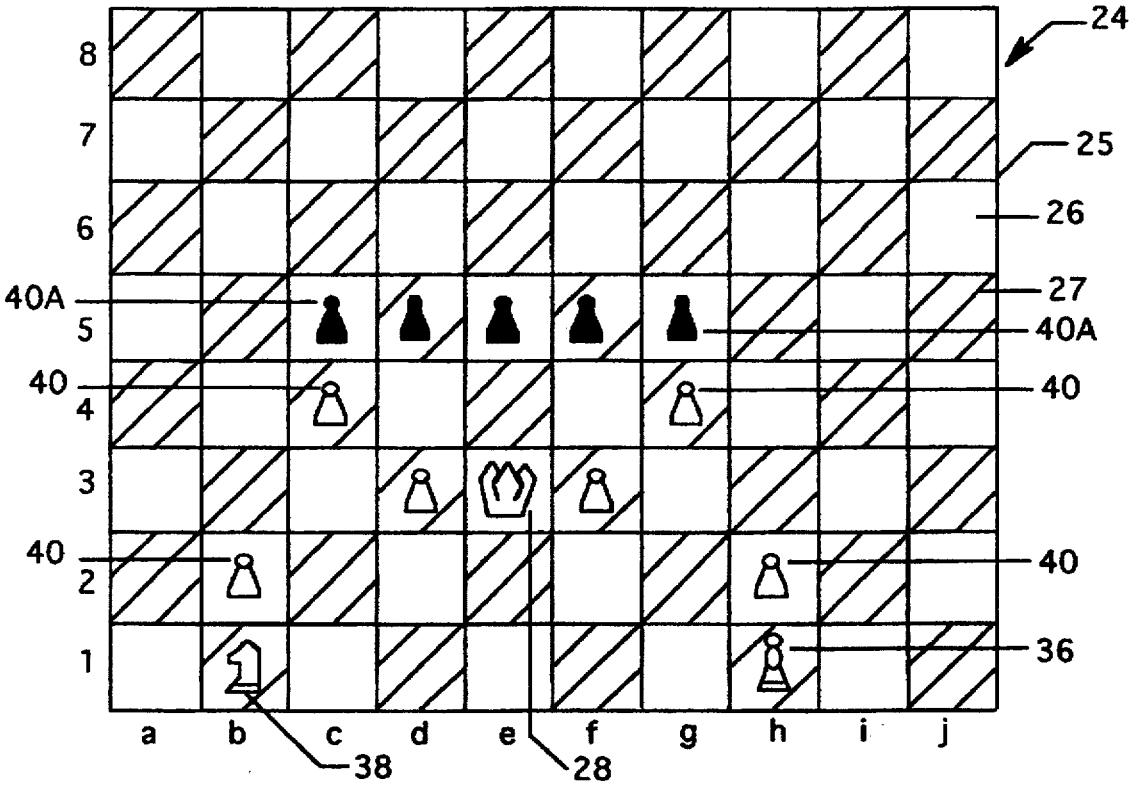
FIG. 22 shows the falcon's inability to move from a position on the game board.

Another consequence of the falcon's move is that the pawn is a very effective piece to block off or trap the falcon. The falcon cannot move just one or two squares, but must move three squares, in the specified ways, and cannot jump. As a result, the falcon is vulnerable in close-up positioning, the more so on a crowded board, before many pieces have been captured. In actual game conditions, the number of squares the falcon can move to range from the sixteen squares shown in FIG. 19 all the way down to zero squares. The latter case is represented in FIG. 22 by a falcon 28 on square e3. The pieces shown in FIG. 22 do not fully represent a game position, because the kings are omitted for simplicity. Falcon 28 has no square to which to move, in spite of all the empty squares around it. In the configuration shown, the position of falcon 28, some of white's own pieces, and a row of five black pawns 40A all combine to militate against any possible move. The bishop, the rook, the queen, or the knight positioned on square e3 could simply capture one of enemy pawns 40A, but falcon 28 is unable to do so. This complete immobilization of the falcon after opening moves is somewhat unusual. More frequently, game positions arise in which the falcon's movement is restricted to just a few choices, most often because of strategically interposed pawns.

The falcon's initial position, shown in FIG. 1, between either the king or the queen and the bishop enables it to reach, on its first move, one of the squares in the file row at a side edge of the game board, if a player chooses. More particularly, after a bishop's pawn 40, 40A has moved, a falcon 28, 28A can reach the square in from of the rook's pawn on that falcon's side of the king. FIG. 1 shows the initial positions, and FIG. 14, among others, identifies the squares referred to, a3, j3, a6, and j6, read from the letter-number designations for rank-file. These useful flank positions, after just one move of the falcon, enable it to become actively involved in the opening game.

Free Castling

In the preferred embodiment, a form of castling, characterized as "free castling," used historically in some lands, applies as follows. To castle, the king moves over unoccupied squares to any square between it and the rook. Then, as in the orthodox way, the rook moves over the king to the adjacent square. Specifically, in FIG. 23, a king 30 can move from f1 to any of the squares e1, d1, c1, or b1, as part of a castle maneuver on the queen's side. A king 30A can move from f8 to any one of g8, h8, or i8, as part of castling on the king's side. Either king can, of course, castle with either of its rooks, one side or the other, by this free placement of the king to any square between the king and the rook. As in orthodox, Falcon Chess castling requires unoccupied and unthreatened squares intervening between the king and the rook, to enable the castle. The castling move is completed by the placement of the rook over the king to the adjacent square.

Figure 23:
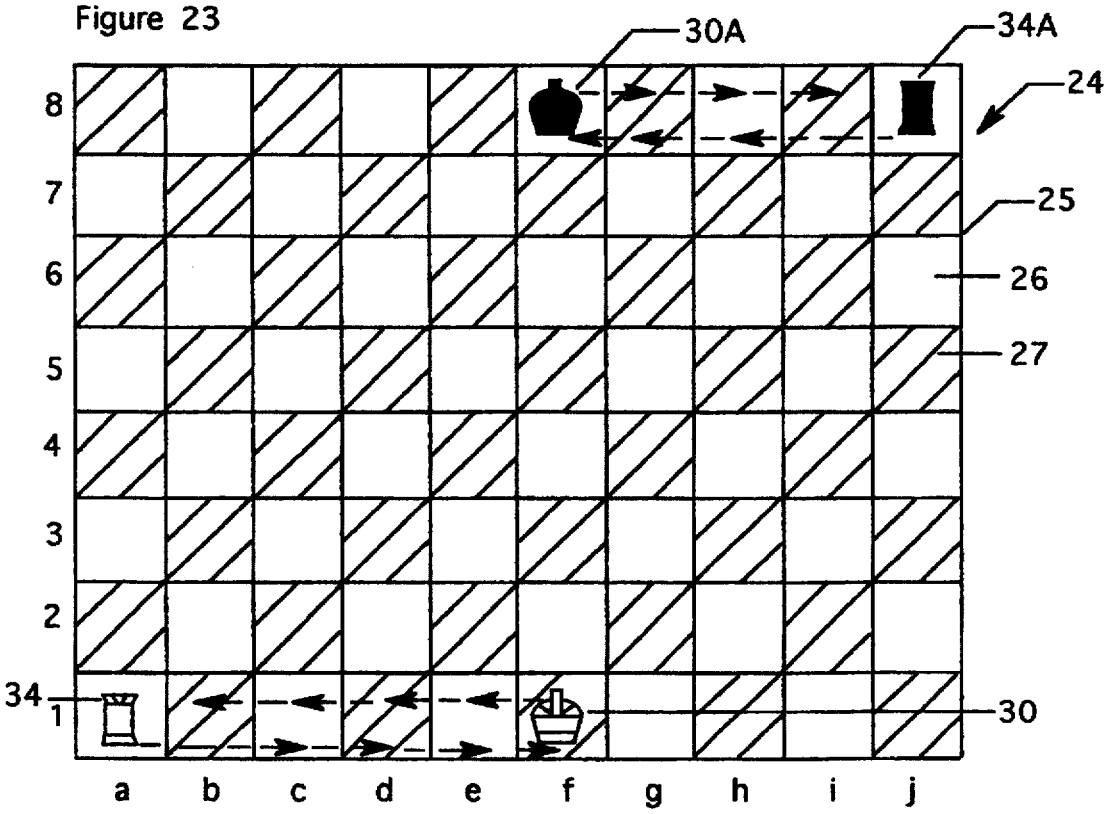
FIG. 23 shows free castling on the king's side for white and on the queen's side for black on the game board.

Free castling is part of the preferred embodiment of Falcon Chess 24, as presently envisioned, to optimize this chess re-design. Free castling adds to the squares to which the king can move in castling. It is also possible to implement a variation of the preferred embodiment in which orthodox castling prevails. Orthodox castling positions permissible are just a subset of the acceptable free castling positions. In FIG. 23, orthodox castling permits king 30 to move to d1 only in a queenside castle, and king 30A to move to h8 only in a kingside castle. Still another variation modifies free castling, whereby the squares on which the king can stop are one fewer in number, excluding the one square closest to the king's initial position. This arrangement is intermediate between free castling and orthodox castling.

Conclusions, Ramifications, and Scope

Effects of the Game

The three-square move of the falcon is of intermediate range between those of the pawn and the knight on one hand and those of the bishop, the rook, and the queen on the other. With this intermediate range of mobility in a well-defined and limited move, the falcon does not greatly affect the existing relative valuations among the pieces. The relationships of the values among themselves of the pawn, the knight, the bishop, the rook, and the queen remain about the same in Falcon Chess, retaining fundamental counterpoise and interplay. Bishop 36, rook 34, and queen 32 still have importance as the pieces that can traverse the board in one move. Knight 38 remains the only piece that can jump. In addition, the role of each is extended in Falcon Chess in a synergistic alteration, as a result both of the larger board size and the characteristics of the new falcon piece's move, that the orthodox pieces must adjust to and confront.

Most importantly, Falcon Chess 24 becomes a wholly new game, with new strategies overlaying those of the orthodox game and multiplied possible scenarios of play. Greatly increased combinations of play ensue from the introduction of free castling alone, appropriate for the larger board size. Occasionally, particularly when all falcons have been captured, the game position corresponds essentially to one that can occur in orthodox chess, and strategies devolve mostly to those of the orthodox game.

With the introduction of falcons 28, 28A, two for a side, the number of combinations or permutations possible, for various positions and patterns of moves, increases by factors of thousands at least. Even as advantageous patterns of play are discovered, computers will not have significant advantages over human players for some indefinite, extended period of time, because of the vastly increased programming complexity.

From a centrally positioned square on the eight-by-ten game board 25 (FIGS. 1, 14, 15, 17 and 18–23 all show the full game board.) without any obstructing pieces, bishop 36 can reach fourteen possible squares, rook 34 sixteen possible squares, and falcon 28 sixteen possible squares. The falcon's sixteen squares are shown specifically in FIG. 19. However, the falcon is a more valuable piece than either the bishop or the rook, by virtue of the falcon's ability to reach each of its squares three different ways. In estimating exchange values of pieces, the falcon is of somewhat less value than the queen. While knight 38 reaches only eight possible squares from a central position, its ability to jump raises its value nearly to that of the bishop, in both orthodox and Falcon Chess 24. Mentioned above in the history of chess, also because of this jumping ability, three alternative descriptions of the knight's two-square move are really one and the same move. In contrast, the falcon has no leaping ability. As a result, its three ways, or triple option, to reach a square are, for purposes of play, distinct and separate moves.

Indeed, the falcon has an original movement in its own right. The falcon cannot traverse the board in one move, as can the bishop and the rook. At the same time, the falcon is of more value than each of those pieces. The falcon's move is a non-jumping three squares, versus the knight's jumping two squares. With its twelve movement patterns and three-fold way, the falcon is a very versatile piece that complements, rather than duplicates or truncates, the moving powers of the traditional pieces.

The Falcon's Characteristics

Only the falcon is able to reach a given square in more than one way. The falcon offers sets of choices among its twelve movement patterns, which can be restricted by circumstances on the board. One, or two, or all three alternative ways to traverse a legal three-square path may be blocked. As discussed, the knight's "three ways" of moving to a square are only alternative descriptions of the same move. Awareness of the falcon's three-fold way to reach a square critically affects strategy in actual play. A move may be blocked altogether. A move may have one or two of three paths blocked, prompting an opponent to move another piece to an intervening square that completes the block.

Another characteristic of the falcon is that its flexibility makes it the greatest forking threat, as shown in FIG. 21 and already discussed. This forking action at a distance is hard to anticipate and often leads to a trap of an opponent's major piece. With the ability to pose threats across combinations of squares the other pieces cannot travel, the falcon opens up new, unanticipated dimensions to the game.

Still another characteristic is that the falcon is the most important piece (excluding the king) that moves a specified number of squares. While the move's flexibility offers advantages, that the move must be three squares imparts a vulnerability to the falcon. Especially when many pieces are crowded together, the options for fully three-square moves become more limited, as shown in FIG. 18. Indeed, the falcon can often be attacked by pieces one or two squares away that it cannot threaten in return. A move may even be nonexistent for the falcon, as shown in FIG. 22.

The Role of Pawns

More so than the other orthodox pieces, pawns 40, 40A have an expanded role in Falcon Chess 24, and their strategic importance cannot be overemphasized. First of all, there are more pawns, ten instead of eight, as FIG. 1 shows, whereas the other orthodox pieces do not increase in number. Unlike chess expansions that increase the number of rank rows, in Falcon Chess, the pawns can engage after an opening of two squares by each player. In other words, opposing pawns are potentially only one square apart after just one pawn move per side, as in orthodox chess.

Any one of the three adjacent pawns ordinarily must have moved for the falcon to be able to leave its initial position, since the falcon does not jump. Thereafter, the pawns are the pieces most likely to block opposing falcons' various moves. Also, the pawn is frequently used to open up or disclose a move for one of the falcons of the same color. That is, the falcon's move, which is blocked by some same-colored pawn, materializes simply by moving the pawn. While this effect also can benefit other pieces, it is most important for the falcon, because of the falcon's triple option of moving to a square.

If anything, in a new equilibrium, the pawn's value increases somewhat, compared to the other orthodox pieces, by the expansion to Falcon Chess. As mentioned, the falcon itself becomes a major piece of more value than the rook, but less than the queen. The falcon's value fluctuates in the course of the game, wherein it is relatively disadvantageous in the middle game, when the center is crowded and pawn play is more important. Research and subsequent literature should show effective falcon play in the opening, middle, and end game, strategies for the important interaction of the falcons and the pawns, and other aspects of the new game.

Novelty of the Falcon's Move

A piece that has, for example, a move of only one diagonal followed by two straight would not have the new, unexpected effects the falcon has in Falcon Chess. Nor would a piece that has a move of only one straight followed by two diagonal enhance chess much in an expanded variation. For instance, neither of these two hypothetical pieces would create either the long-rage forking possibilities or the greater roles for the pawns, which the falcon creates with its much more versatile move. The two moves described above are, in fact, a portion of the falcon's full range of movement choices. However, it takes all the movement patterns together and the other various factors of the falcon's way of moving, as described, to achieve the unexpected and exciting effects of this chess improvement. It is critical, for example, that the falcon is not able to reach, from a starting square, all of the other squares within a surrounding seven-by-seven array of squares. Instead, the falcon can move to only those sixteen squares, specified by its manner of moving, situated on the outside perimeter, within the array. The sum of all the components of the falcon's move taken together maximize the move's potential when the falcon is conjoined with the orthodox pieces on the eight-by-ten game board in Falcon Chess.

The novel features of the falcon's move include the following:

(1) The falcon has three ways to reach any of its squares, a triple option that has not appeared before in a true chess-like game.

(2) The falcon reaches squares that no orthodox piece can reach from the same starting square. Thus, the falcon is neither a composite piece, nor a limited orthodox piece.

(3) The order of its three steps, totalling three squares, is immaterial. For example, a move with only one straight step can have that straight step first, second, or third, regardless. In this case, two necessarily diagonal steps (in the same direction) are the other steps, whether second and third, first and third, or first and second. This unusual feature is unique in a chess-like game.

(4) The falcon reaches each of its squares either by a split block or a split diagonal move. These unique forms increase the falcon's maneuverability and enhance the interpositional uses of the pawns.

(5) An unexpected result of the falcon's one-of-a-kind method of movement is its forking ability across a wide range of squares, illustrated in FIG. 21.

(6) The falcon's advancement pattern, characterized as "eight-three-two," is illustrated in FIG. 17. The meaning is that, without intervening pieces, there are eight one-square choices for the first step of the move, three one-square choices for the second step, and two one-square choices for the third step, adding up to the three squares.

Straight or Diagonal

As previously discussed, the falcon's move offers a range of choices signified by the notations SSD, DDS, SDD, DSS, SDS, and DSD, where 'S' is straight and 'D' is diagonal. These all represent valid moves, provided that a (non-zero degree) change of direction is by forty-five degrees, and two such changes of direction in the same move have opposite orientations, in effect, cancelling each other out. There is a symmetry in these offerings, wherein neither straight nor diagonal is favored in the over-all range of patterns. The move is in no way limited, for example, to starting with one diagonal. The move can equally well start with one straight instead. Before a forty-five degree change of direction, the falcon's various moves can begin with one diagonal step, one straight step, two diagonal steps, or two straight steps, as the twelve basic movement patterns in FIGS. 2 through 13 show.

There is at least one straight and one diagonal choice for each of the first two steps in the move, as shown in FIG. 17. Initially, there are eight choices, four diagonal and four straight, that is, a king-like move for the falcon's first step. In the second step, there are three choices, at least one straight and at least one diagonal. Whether the first step is straight or diagonal, in turn, affects whether the second step offers two straight or two diagonal among its three choices. The third step in the three-step move further depends on the first two steps for its straight-or-diagonal array of choices. Depending on the first two steps, the third step may require one of two straight choices, or one of two diagonal choices, or one of either a straight or diagonal choice, all three arrays of choices being possible. While the first two steps just take the piece over two intermediate squares, their orientation determines the directions possible for the third step and, thus, the exact final two squares that are available. In this way, any one move of the falcon creates its own possibilities in its very unfolding, the first step delimiting the choices for the second step, and the second step further delimiting those of the third.

The Logic in the Transformation

As discussed with reference to FIG. 20, the falcon is the piece capable of moving to exactly those squares in a seven-by-seven array from its center, which the combined movements of both the knight and the queen cannot. As such, the falcon is, by this inversion of capabilities, an outgrowth of two orthodox pieces. The queen just combines the powers of the rook and the bishop. It is just as accurate, therefore, to say that the falcon moves to those squares in a seven-by-seven array that the rook, the bishop, and the knight, all three, cannot. In this way, the falcon is the manifestation or reification precisely of what the sum of those orthodox pieces is not. Instead of combining powers of two or more orthodox pieces, as prior art preferentially advocates, the falcon actualizes the moving power that all the others lack. The logic of using this counter, or antithetical, capability is that it complements and mutually reinforces existing pieces' moving powers. By the exclusiveness of its way of moving, the falcon effectively forces play of the other pieces that resonate beyond their previous implementations, in response to the challenge This hitherto undiscovered and undisclosed methodology invokes a chess improvement that enables classical chess to extend toward its full potential. In so doing Falcon Chess is the most coherent extension, conceived in the orthodox tradition and transcending it, creating, as it were, "the missing piece."

Discussed in the prior art was the fact that there are 392 unique three-square moves from a starting square, without passing through any square twice. The falcon utilizes forty-eight of these to reach sixteen different squares, each by any of three different ways. All forty-eight of these, and only these forty-eight, are indicated by the falcon's rule of movement. That is, the move is comprised, in any order, of two steps in the same direction, either straight or diagonal, and one of the other, provided that a change of direction from straight to diagonal, and vice versa, is by forty-five degrees. Those requirements are the consistent, coherent pattern of advance for the falcon. The sixteen squares reachable are the very ones that the orthodox queen and knight cannot move to from the center of a seven-by-seven array of squares. Of the trillions upon trillions of different combinations of forty-eight moves that can be taken from 392 choices of moving three squares, Falcon Chess utilizes only the one unique combination for the new, separate falcon game piece.

At its roots, chess mobilizes elements of force, space, and time into interactions, subject to probabilities and amenable to analysis. At the present time, because of the vast knowledge of possible game positions and their replications in books and computers, there is an emerging sense of deja vu or even stagnation in the world's best game. The elegant royal game currently needs fresh ideas and rejuvenation. Henceforth, the falcon and its novel move combine with the old and proven pieces, multiplying possibilities for manifold new interactions to form this chess expansion in a synergistic transformation of the orthodox method, in a sense, making a nearly perfect game move still closer to perfection.

Other Embodiments

Numerous characteristics and advantages of the preferred embodiment of Falcon Chess 24 have been set forth in the foregoing description. Nevertheless, obvious derivations of the preferred embodiment are possible, for example, wherein the board size is adjusted to nine-by-ten or ten-by-ten, and the pieces remain the same. As already indicated, free castling is not essential to the conception, and a modified free castling, or even orthodox castling, may be used, giving rise to other alternative embodiments. In one alternative embodiment, pawn promotion upon entering the final rank permits promotion to any other piece except the king and the queen.

Other changes in details may be made without departing or detracting from the intent, spirit, and scope of the invention. For example, the chess board can be foldable, even having a cavity for storage of the pieces, when the board is closed. As another example, chess pieces that look different from those in FIG. 1A, or have a different name, but function the same, can be employed.

Another possible embodiment is that in which the falcon has the ability to jump or leap over an intervening piece, as the knight can. In another alternative, the falcon can be positioned between the bishop and the knight, in conjunction with the larger game board sizes, nine by ten or ten by ten, just mentioned. In all these cases, the falcon retains its unique three-square movement. Still another alternative of Falcon Chess is that in which the checkered square pattern is reversed, so that from each player's view, the closest, rightmost square is white, instead of black. Another alternative reverses the initial position of the king and the queen. All such modifications that are obvious changes in detail are regarded as within the spirit and scope of the invention.

The preferred embodiment of Falcon Chess has been disclosed in terms of tangible playing pieces and game board. Obviously, a computer or electronic version can also be implemented. Computer programmers can create the computer version, based on the preferred board size and rules of movement of the pieces. The method of movement of the new, separate falcon game piece can be programmed into software, and all the pieces and game board represented upon a computer screen. Computer software programs can incorporate effective strategies of play of Falcon Chess, as they become apparent from repeated play and analysis. Thus, the drawings herein of standard Falcon Chess can indicate images on a computer, electronic manifestations of lines of code in computer software, as well as the tangible form. Along the same lines, while Falcon Chess has been described as a game of skill between two human players, it can also be implemented as a skill game between one person and a computer opponent.

The expanded chess-like game, called Falcon Chess, has been disclosed in detail in terms of one preferred embodiment, and the description does contain the specificities that expand orthodox chess to Falcon Chess in the best way envisaged, whether the form of implementation of the method of play is tangible or whether it is electronic. The discussed variations and modifications of Falcon Chess arise from changes in the rules adopting free castling, board size and square pattern, and the appearances of the pieces. Without detracting from the preference for the embodiment of Falcon Chess hereinbefore described in detail, these and such-like variations are within the scope and spirit of the invention. Therefore, the detailed description of the preferred embodiment should not limit the scope and range of this invention to its exact delineation. Instead, the appended claims and their legal equivalents should determine the scope of the invention.

I claim:

1. A method of playing an expanded chess-like game for use by a first player against a second player, comprising the steps of:

(a) providing a game board with alternate light-colored and dark-colored squares, arranged in adjacent vertical and horizontal rows, each of said rows including said alternate light-colored and dark-colored squares, each square offset with respect to the similarly-colored square of the adjacent row, to form a checkerboard pattern of bilaterally alternating colored squares, said game board having at least eight and fewer than eleven horizontal rows and ten vertical rows;

(b) providing a plurality of playing pieces, including one set of light-colored pieces for one player and one set of dark-colored pieces for the other player, each set of pieces comprising ten pawns, one king, one queen, two rooks, two bishops, two knights, and two of a new separate game piece, which is visually distinguishable from the others;

(c) initially positioning said set of light-colored pieces, at the start of a game, in the first row of ten squares at one end of said game board from left to right in the sequence, rook, knight, bishop, said new separate game piece, said queen, said king, said new separate game piece, bishop, knight, and rook, with the light-colored pawns being initially positioned in the adjacent row of ten squares at said end of said game board;

(d) initially positioning said set of dark-colored pieces in the row of ten squares at the opposing end of said game board from left to right in the sequence rook, knight, bishop, said new separate game piece, said king, said queen, said new separate game piece, bishop, knight, and rook, with the corresponding pieces of the two sets being initially located in the same vertical row at its opposite ends of said game board, with the dark-colored pawns being positioned in the adjacent row of ten squares at said opposing end of said game board;

(e) formatting predetermined rules of movement for play wherein each of the kings, the queens, said rooks, said bishops, said knights, and said pawns have the same rule of movement as the corresponding piece in orthodox chess;

(f) formatting predetermined rules of movement for play wherein said new separate game piece has a rule of movement on said game board totalling three squares, by three straight-or-diagonal steps of one square each, by moving from a starting square, on which said new separate game is positioned, by a first straight-or-diagonal step of one square over a first intermediate square, different from said starting square, thence by a second straight-or-diagonal step of one square over a second intermediate square, different from said starting square and said first intermediate square, and thence by a third straight-or-diagonal step of one square to a final square, different from said starting square, said first intermediate square, and said second intermediate square, said first intermediate square and said second intermediate square being unoccupied by any other playing piece, a transition from said first straight-or-diagonal step of one square to said second straight-or-diagonal step of one square defining one angled change of direction, and a transition from said second straight-or-diagonal step of one square to said third straight-or-diagonal step of one square defining a second angled change of direction;

(g) formatting predetermined rules of movement for play wherein said rule of movement of said new separate game piece further requires:

(1) that at least one of the three straight-or-diagonal steps be straight, and that at least one of the three straight-or-diagonal steps be diagonal;

(2) that the angled change of direction from said first straight-or-diagonal step of one square to said second straight-or-diagonal step of one square be only zero degrees, or forty-five degrees to the right, or forty-five degrees to the left;

(3) that the angled change of direction from said second straight-or-diagonal step of one square to said third straight-or-diagonal step of one square be only zero degrees, or forty-five degrees to the right, or forty-five degrees to the left;

(4) that no more than one of the two angled changes of direction be forty-five degrees to the right, and that no more than one of the two angled changes of direction be forty-five degrees to the left, whereby said new separate game piece has three, and only three, ways to move to said final square;

(h) formatting predetermined rules of movement for play wherein said set of light-colored pieces and said set of dark-colored pieces operate in said expanded chess-like game according to the rules of orthodox chess governing capture, a castling move, a pawn promotion, check, and checkmate.

2. The method of claim 1 wherein said game board has fewer than ten horizontal rows.

3. The method of claim 1 wherein said game board has eight horizontal rows.

4. The method of claim 3 wherein said new separate game piece is called a falcon.

5. The method of claim 4 wherein the rightmost square in said first row of ten squares of said game board is a dark-colored square.

6. The method of claim 5 wherein in said castling move allows said king to move two or more squares toward the rook and the rook to move over said king to the adjacent square.

7. The method of claim 5 wherein said castling move allows said king to move one or more squares toward the rook and the rook to move over said king to the adjacent square.

8. The method of claim 7 wherein said pawn promotion permits the pawn to be promoted to any other piece except said king and said queen.

9. A method of playing an expanded chess-like game for use by a first player against a second player, comprising the steps of:

(a) providing a game board with alternate light-colored and dark-colored squares, arranged in adjacent vertical and horizontal rows, each of said rows including said alternate light-colored and dark-colored squares, each square offset with respect to the similarly-colored square of the adjacent row, to form a checkerboard pattern of bilaterally alternating colored squares, said game board having at least eight and fewer than eleven horizontal rows and ten vertical rows;

(b) providing a plurality of playing pieces, including one set of light-colored pieces for one player, and one set of dark-colored pieces for the other player, each set of pieces comprising ten pawns, one king, one queen, two rooks, two bishops, two knights, and two of a new separate game piece, which is visually distinguishable from the others;

(c) initially positioning said set of light-colored pieces, at the start of a game, in the first row of ten squares at one end of said game board, with said king, said queen, said rooks, said bishops, said knights, and two of said new separate game piece all at predetermined locations each on one of the squares, with the light-colored pawns being initially positioned in the adjacent row of ten squares at said end of said game board;

(d) initially positioning said set of dark-colored pieces in the row of ten squares at the opposing end of said game board, with said king, said queen, said rooks, said bishops, said knights, and two of said new separate game piece all at predetermined locations each on one of the squares, so that the corresponding pieces of the two sets are initially located in the same vertical row at its opposite ends of said game board, with the dark-colored pawns being initially positioned in the adjacent row of ten squares at said opposing end of said game board;

(e) formatting predetermined rules of movement for play wherein said new separate game piece has a rule of movement on said game board totalling three squares, by three straight-or-diagonal steps of one square each, by moving from a starting square, on which said new separate game piece is positioned, by a first straight-or-diagonal step on one square over a first intermediate square, different from said starting square, thence by a second straight-or-diagonal step of one square over a second intermediate square, different from said starting square and said first intermediate square, and thence by a third straight-or-diagonal step of one square to a final square, different from said starting square, said first intermediate square, and said second intermediate square, said first intermediate square and said second intermediate square being unoccupied by any other playing piece, a transition from said first straight-or-diagonal step of one square to said second straight-or-diagonal step of one square defining one angled change of direction, and a transition from said second straight-or-diagonal step of one square to said third straight-or-diagonal step of one square defining a second angled change of direction;

(f) formatting predetermined rules of movement for play wherein said rule of movement of said new separate game piece further requires:

(1) that at least one of the three straight-or-diagonal steps be straight, and that at least one of the three said straight-or-diagonal steps be diagonal;

(2) that the angled change of direction from said first straight-or-diagonal step of one square to said second straight-or-diagonal step of one square be only zero degrees, or forty-five degrees to the right, or forty-five degrees to the left;

(3) that the angled change of direction from said second straight-or-diagonal step of one square to said third straight-or-diagonal step of one square be only zero degrees, or forty-five degrees to the right, or forty-five degrees to the left;

(4) that no more than one of the two angled changes of direction be forty-five degrees to the right, and that no more than one of the two angled changes of direction be forty-five degrees to the left, whereby said new separate game piece has three, and only three, ways to move to said final square.

10. The method of claim 9 further comprising the step of:

(g) formatting predetermined rules of movement for play wherein each of the kings, the queens, said rooks, said bishops, said knights, and said pawns have the same rule of movement as the corresponding piece in orthodox chess.

11. The method of claim 10 wherein said game board has eight horizontal rows.

12. The method of claim 9 further comprising the step of:

(h) formatting predetermined rules of movement for play wherein said set of light-colored pieces and said set of dark-colored pieces operate in said expanded chess-like game according to the rules of orthodox chess governing capture, a pawn promotion, check, and checkmate.

13. The method of claim 12 wherein said pawn promotion permits the pawn to be promoted to any other piece except said king and said queen.

14. The method of claim 13 wherein said new separate game piece is called a falcon.

15. The method of claim 9 wherein said game board has fewer than ten horizontal rows.

16. The method of claim 12 wherein the rightmost square in said first row of ten squares of said game board is a dark-colored square.

17. The method of claim 9 wherein said game board has eight horizontal rows.

18. The method of claim 9 wherein said new separate game piece is called a falcon.

* * * * *